US007313937B2

(12) United States Patent
Straka, Jr.

(10) Patent No.: US 7,313,937 B2
(45) Date of Patent: Jan. 1, 2008

(54) LATCH

(75) Inventor: Robert Lewis Straka, Jr., Phoenixville, PA (US)

(73) Assignee: Southco, Inc., Concordville, PA (US)

( * ) Notice: Subject to any disclaimer, the term of this patent is extended or adjusted under 35 U.S.C. 154(b) by 117 days.

(21) Appl. No.: 10/850,652

(22) Filed: May 21, 2004

(65) Prior Publication Data

US 2005/0183478 A1 Aug. 25, 2005

Related U.S. Application Data

(63) Continuation-in-part of application No. 10/784,706, filed on Feb. 22, 2004, now abandoned.

(51) Int. Cl.
*E05B 13/10* (2006.01)

(52) U.S. Cl. ..... 70/137; 70/208; 70/215; 70/224; 70/451; 70/461; 292/336.3; 292/337; 292/DIG. 31; 292/DIG. 60

(58) Field of Classification Search ..... 70/137, 70/139, 478, 224, 461, 208, 210, 215, 451, 70/447–449; 292/DIG. 60, 336.3, DIG. 31, 292/337, 129, DIG. 53, 227, 229
See application file for complete search history.

(56) References Cited

U.S. PATENT DOCUMENTS

| | | | | | |
|---|---|---|---|---|---|
| 452,738 | A | * | 5/1891 | Van Winkle | 70/488 |
| 756,447 | A | * | 4/1904 | Von Wobeser | 292/337 |
| 812,904 | A | * | 2/1906 | Voight | 292/337 |
| 876,348 | A | * | 1/1908 | Hall | 70/150 |
| 929,638 | A | * | 7/1909 | Voight | 70/107 |
| 1,120,538 | A | * | 12/1914 | Richardson | 292/93 |
| 1,229,318 | A | * | 6/1917 | Page et al. | 292/337 |
| 1,461,756 | A | * | 7/1923 | Croning | 70/452 |
| 1,462,637 | A | * | 7/1923 | Fetner | 292/227 |
| 2,190,080 | A | * | 2/1940 | Ott | 292/192 |
| 2,238,314 | A | * | 4/1941 | Falk | 292/337 |
| 2,331,115 | A | * | 10/1943 | Fox | 292/227 |
| 2,634,151 | A | * | 4/1953 | Russell et al. | 292/337 |
| 3,039,291 | A | * | 6/1962 | Dusing et al. | 70/451 |
| 3,343,860 | A | * | 9/1967 | Kohler | 292/169.16 |
| 4,192,536 | A | | 3/1980 | Laureano | |
| 4,551,998 | A | * | 11/1985 | Ricouard et al. | 70/69 |
| 5,234,238 | A | * | 8/1993 | Takimoto | 292/216 |
| 5,409,278 | A | * | 4/1995 | Harcourt | 292/357 |
| 5,927,772 | A | | 7/1999 | Antonucci et al. | |
| 6,460,902 | B1 | | 10/2002 | Kyle | |

(Continued)

FOREIGN PATENT DOCUMENTS

| | | |
|---|---|---|
| DE | 4041207 C1 | 12/1990 |

(Continued)

*Primary Examiner*—Lloyd A. Gall
(74) *Attorney, Agent, or Firm*—Paul & Paul

(57) ABSTRACT

A latch is disclosed that can be applied to doors in a variety of orientations and/or with keepers in a variety of orientations without any modifications to the latch being necessary. The latch includes a first module that carries a handle and an actuating member, and the latch includes a second module that includes a latching mechanism. The first and second modules can be secured together with the first and second modules being relatively oriented in any one of a plurality of orientations, while the latch remains operational with the two modules secured together in any of the various orientations.

55 Claims, 28 Drawing Sheets

U.S. PATENT DOCUMENTS

| | | | | |
|---|---|---|---|---|
| D489,958 | S | 5/2004 | Jackson et al. | |
| D489,959 | S | 5/2004 | Jackson et al. | |
| 2003/0025339 | A1 | 2/2003 | Vitry et al. | |
| 2004/0245788 | A1* | 12/2004 | Lin | 292/336.3 |

FOREIGN PATENT DOCUMENTS

| | | |
|---|---|---|
| EP | 0239229 | 9/1987 |
| GB | 547399 | 8/1942 |
| GB | 856362 | 12/1960 |
| GB | 2258008 | 1/1993 |

* cited by examiner

LATCH

CROSS REFERENCE TO RELATED APPLICATIONS

This application is a continuation-in-part of U.S. patent application Ser. No. 10/784,706, filed on Feb. 22, 2004, now abandoned, the entire disclosure of which is incorporated herein by reference.

BACKGROUND OF THE INVENTION

1. Field of the invention

The present invention relates to a latch for releasably securing a first member, such as a door or the like, relative to a second member.

2. Description of the Prior Art

Latches are used to releasably secure panels, covers, doors, electronic modules, and the like to other structures such as compartments, cabinets, containers, doorframes, other panels, frames, racks, etc. Although many latch designs are known in the art, none offers the advantages of the present invention. The advantages of the present invention will be apparent from the attached detailed description and drawings.

SUMMARY OF THE INVENTION

The present invention is directed to improvements in latch design. The illustrated embodiment exemplifying the several inventive concepts of the present invention is a rotary pawl latch provided with a multi-directional mounting. The illustrated embodiment has a rotary pawl, a catch member, an actuating member, and a pivotally movable handle. The rotary pawl is biased toward the unlatched position. The catch member is biased toward engagement with the rotary pawl. The catch member can catch and hold the pawl in the latched position. The catch member must be disengaged from the pawl to allow the pawl to rotate to the unlatched position. The actuating member is biased toward being disengaged from the catch member. A user can bring the actuating member into engagement with the catch member in order to disengage the catch member from the pawl by moving the handle to raised position from a folded-down position. The handle has a cam surface that engages the actuating member and pushes the actuating member into engagement with the catch member. The catch member has a ramp or inclined surface, and the actuating member engages this inclined surface or ramp in such a way that the resultant force moves the catch member out of engagement with the pawl, thereby allowing a member secured by the latch to be opened.

The handle and the actuating member are carried by a first housing, and the pawl and catch member are carried by a second housing. The first and second housings can be secured together with the first and second housings being relatively oriented in any one of a plurality of orientations, while the latch remains operational with the two housings secured together in any of the various orientations.

Accordingly, one object of the present invention is to provide a single latch design that can be applied to doors in a variety of orientations and/or with keepers in a variety of orientations without any modifications to the latch being necessary.

Another object of the present invention is to provide a latch wherein the latch is made up of modules that can be assembled in any one of a plurality of angular orientations relative to one another.

Yet another object of the present invention is to provide a latch wherein the latch is made up of modules that can be assembled in any one of a plurality of angular orientations relative to one another without any modification to the modules.

Still another object of the present invention is to provide a latch wherein the latch is made up of modules such that modules can be easily substituted for to allow a variety of handle styles to be used with the latch.

Still another object of the present invention is to provide a latch wherein the latch is made up of modules such that modules can be easily substituted for to allow a variety of latch mechanisms to be used with the latch.

These and other objects of the invention will become apparent from the drawings and the detailed description appended hereto.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 3:
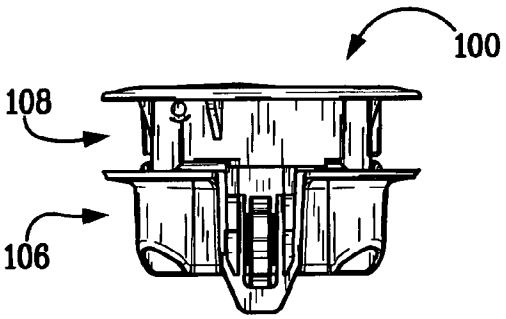
FIGS. 1-6 are views of a latch according to the present invention shown with the handle folded down and the pawl in the latched position.
Figure 6:
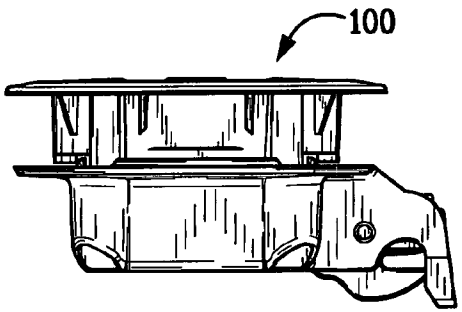
Figure 2:
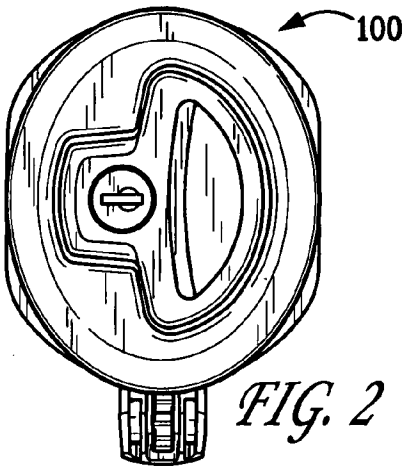
Figure 5:
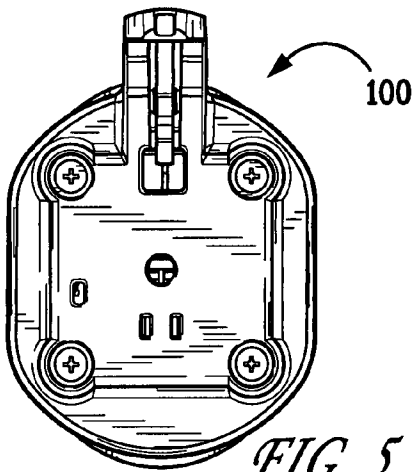
Figure 1:
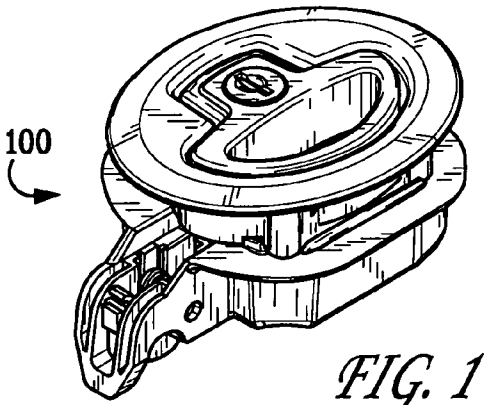
Figure 4:
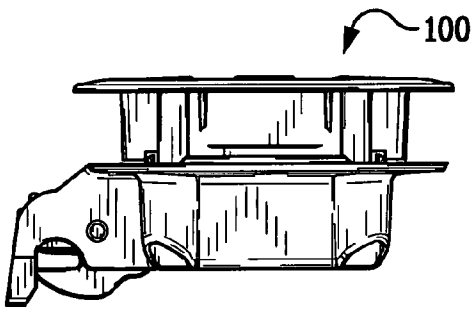
Figure 9:
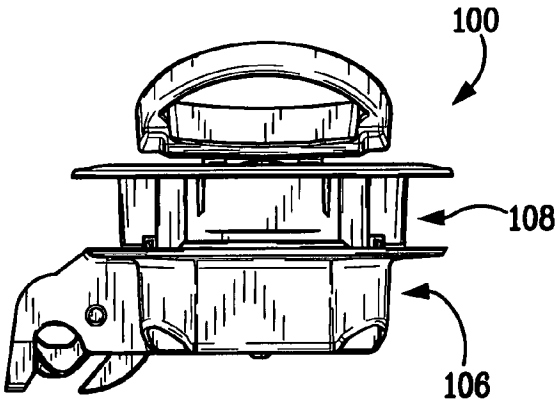
FIGS. 7-12 are views of a latch according to the present invention shown with the handle raised and the pawl in the unlatched position.
Figure 12:
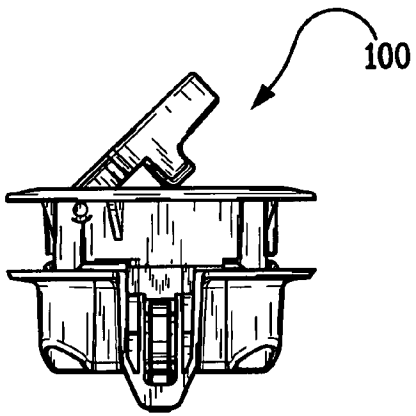
Figure 8:
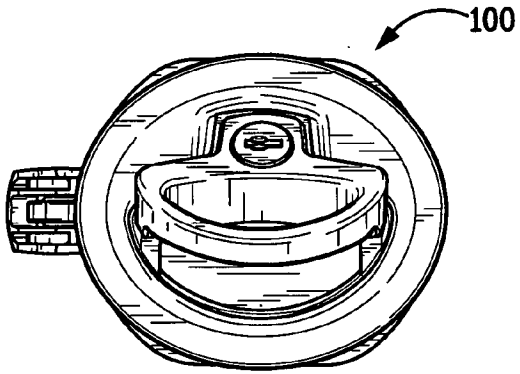
Figure 11:
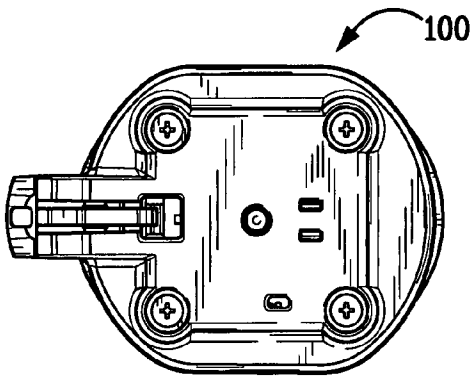
Figure 7:
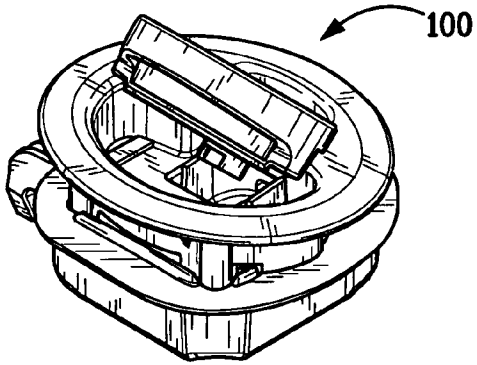
Figure 10:
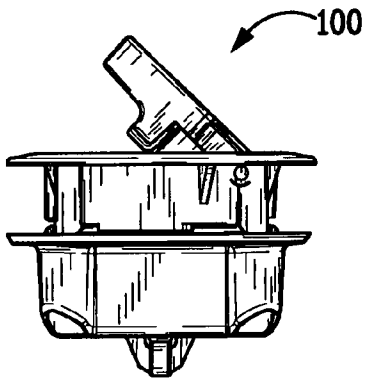
Figure 13:
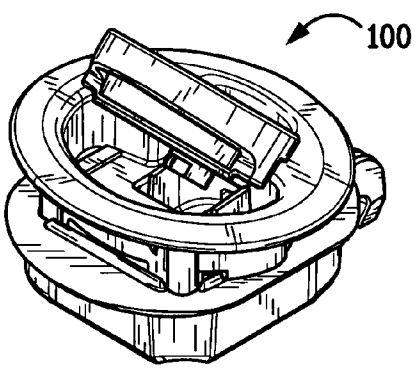
FIGS. 13-18 are views of a latch according to the present invention shown with the handle raised and the pawl in the unlatched position with the latch module in a second orientation relative to the actuator module.
Figure 14:
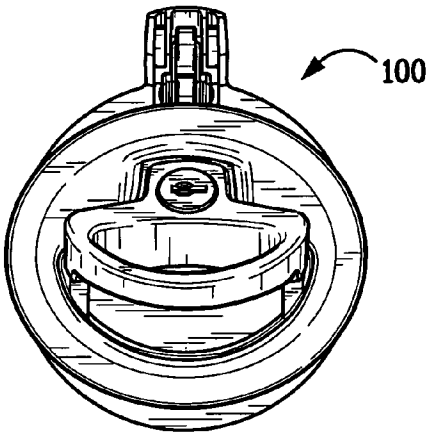
Figure 15:
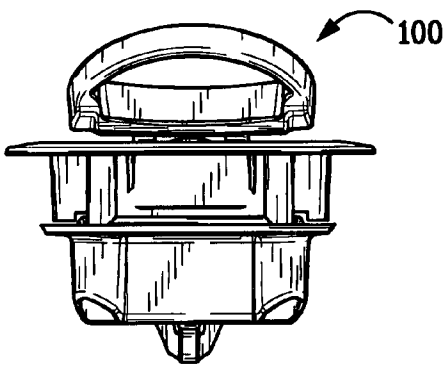
Figure 16:
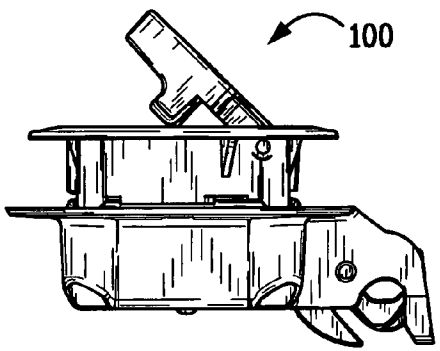
Figure 17:
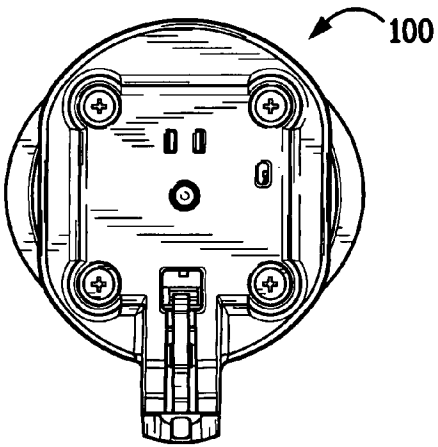
Figure 18:
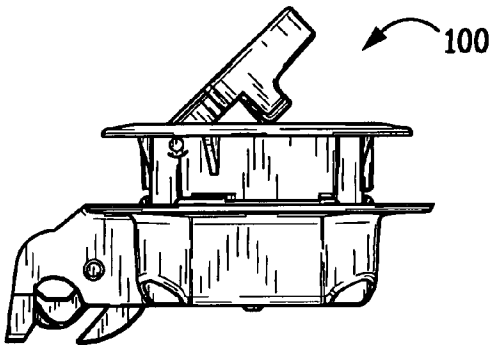
Figure 21:
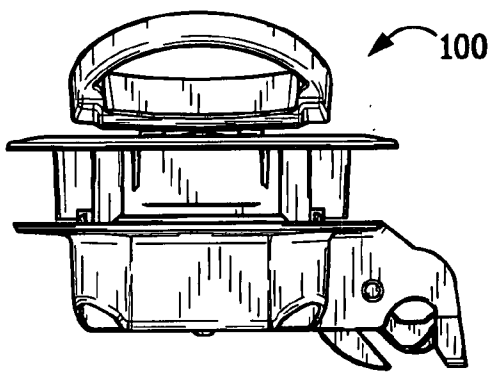
FIGS. 19-24 are views of a latch according to the present invention shown with the handle raised and the pawl in the unlatched position with the latch module in a third orientation relative to the actuator module.
Figure 24:
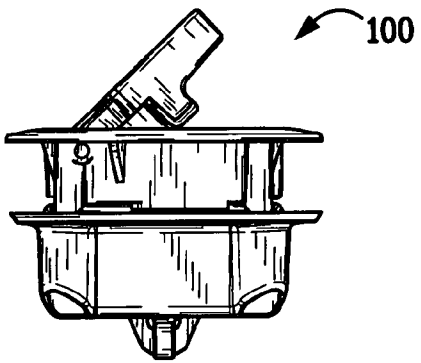
Figure 20:
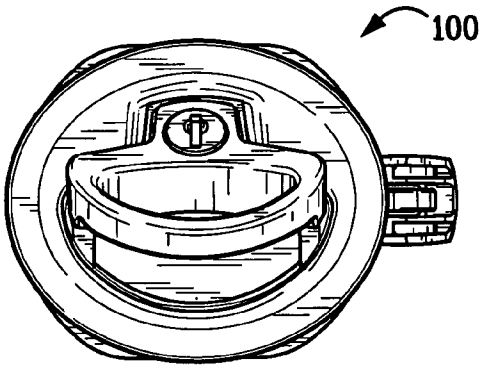
Figure 23:
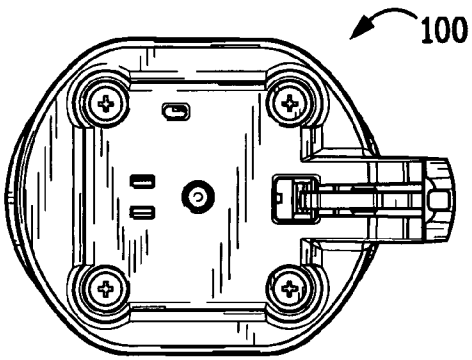
Figure 19:
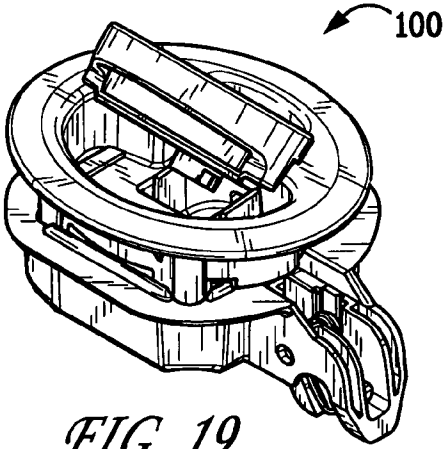
Figure 22:
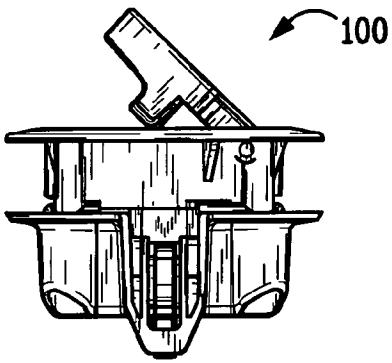
Figure 27:
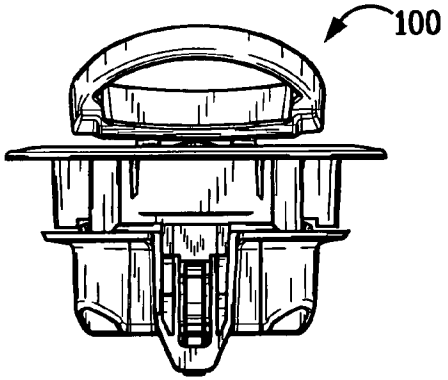
FIGS. 25-30 are views of a latch according to the present invention shown with the handle raised and the pawl in the unlatched position with the latch module in a fourth orientation relative to the actuator module.
Figure 30:
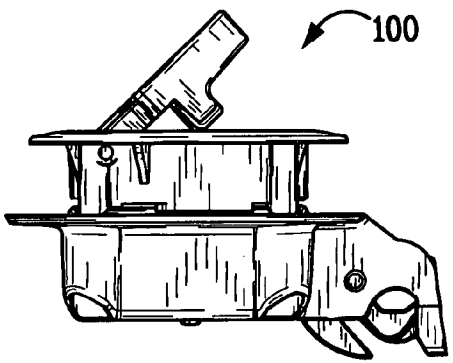
Figure 26:
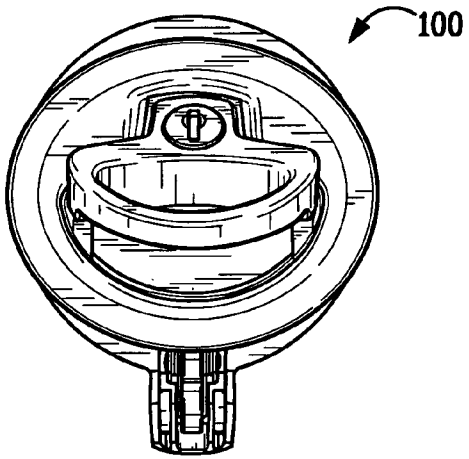
Figure 29:
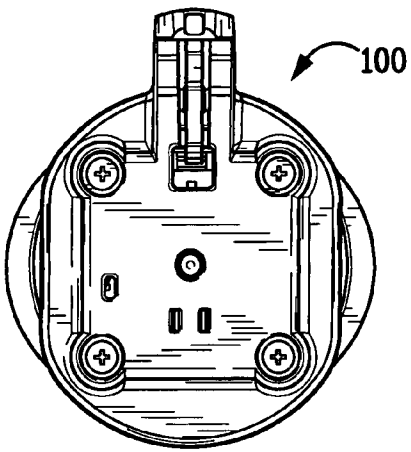
Figure 25:
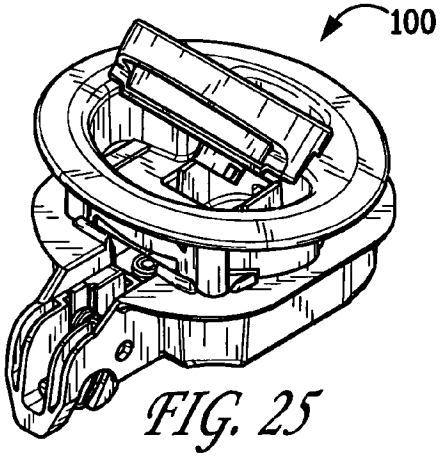
Figure 28:
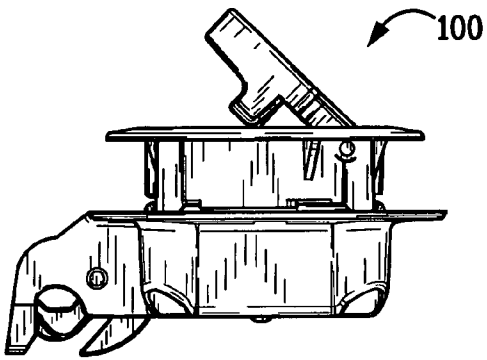
Figure 33:
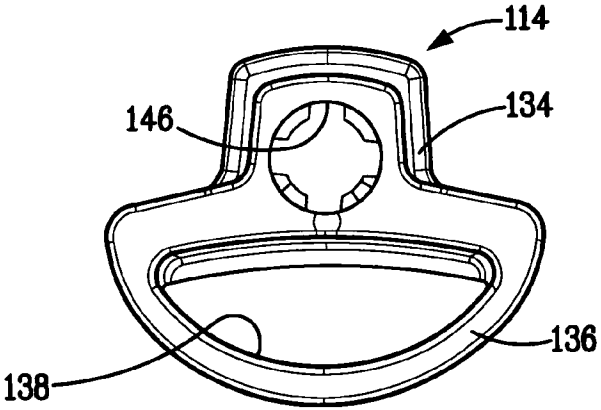
FIGS. 31-36 are views of a handle of a latch according to the present invention.
Figure 32:
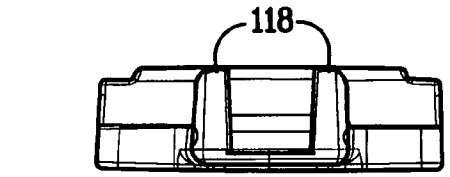
Figure 31:
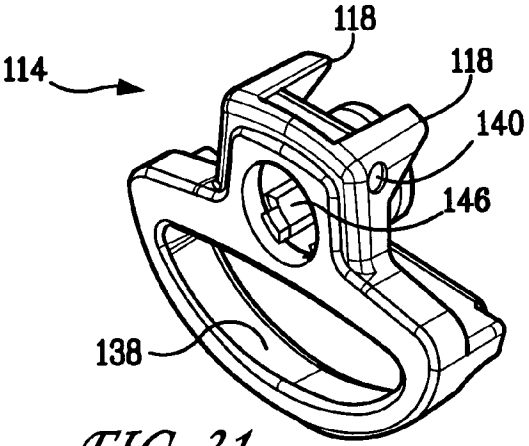
Figure 36:
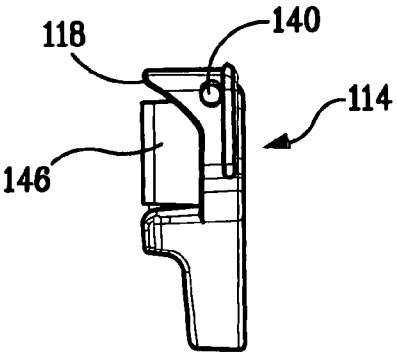
Figure 35:
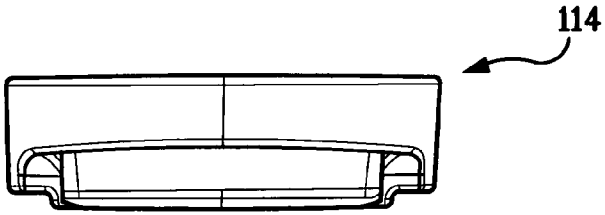
Figure 34:
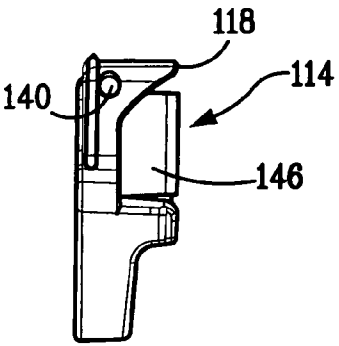
Figure 37:
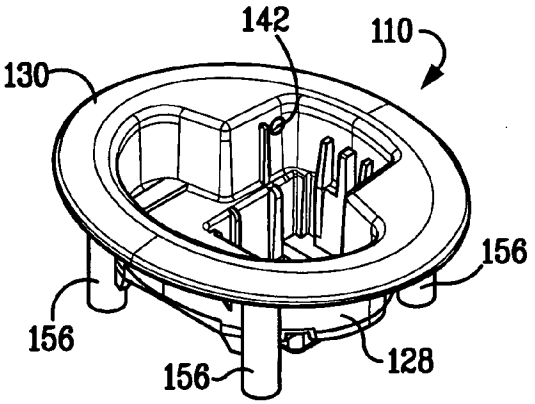
FIGS. 37-42 are views of the housing of an actuator module of a latch according to the present invention.
Figure 38:
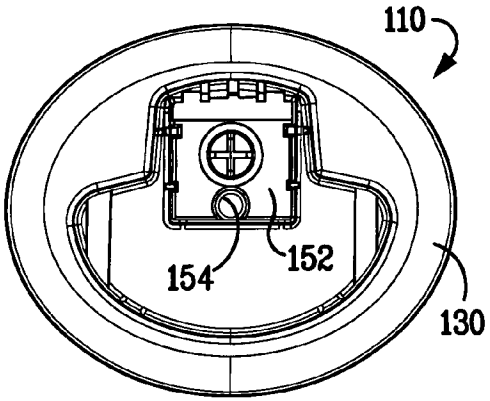
Figure 39:
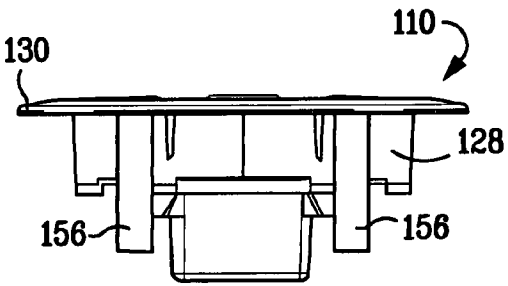
Figure 41:
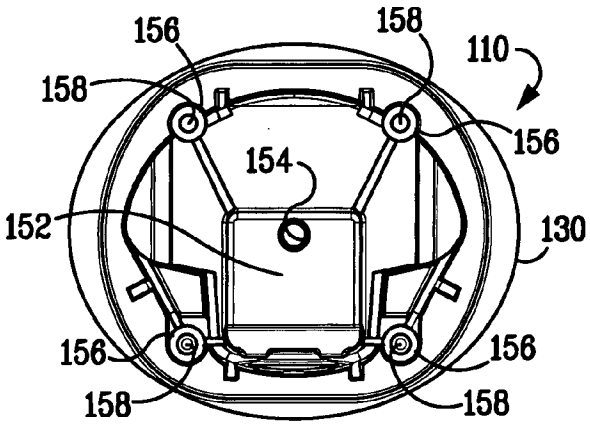
Figure 40:
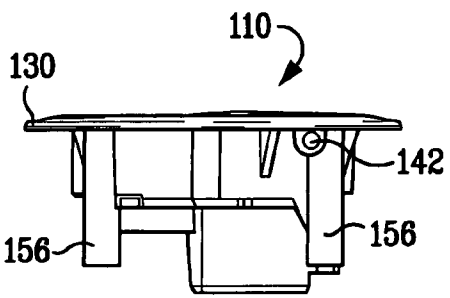
Figure 42:
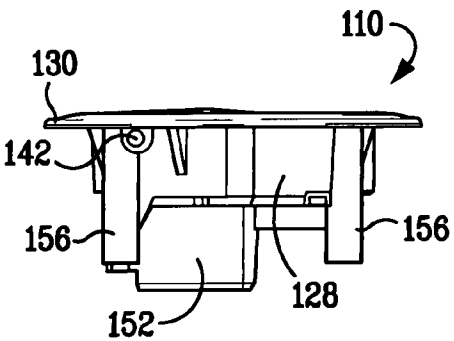
Figure 45:
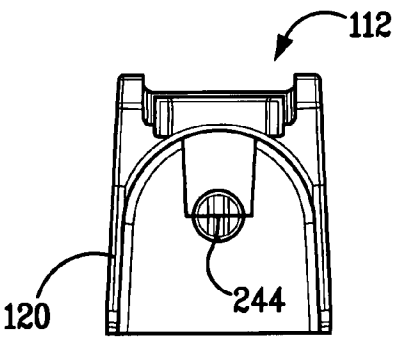
FIGS. 43-48 are views of the actuating member of the actuator module of a latch according to the present invention.
Figure 44:
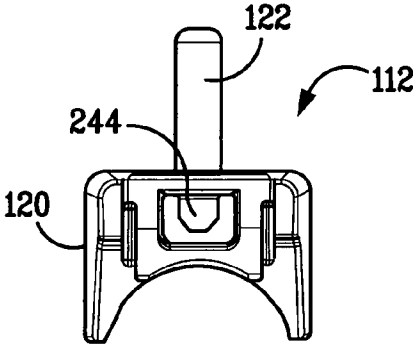
Figure 43:
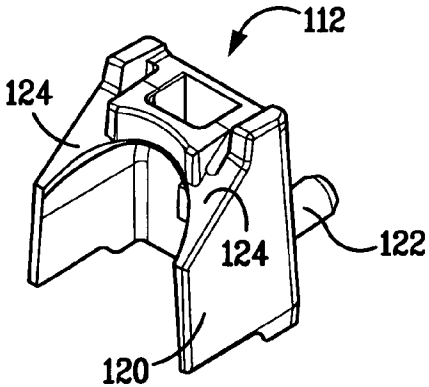
Figure 48:
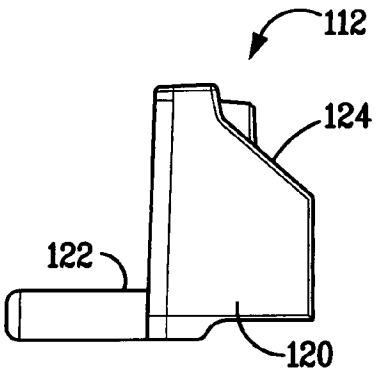
Figure 47:
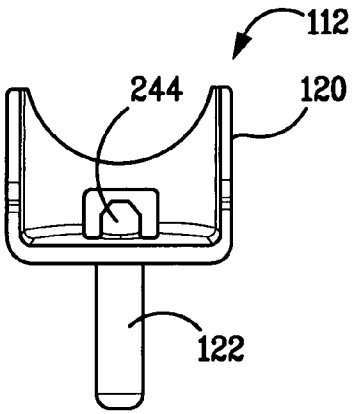
Figure 46:
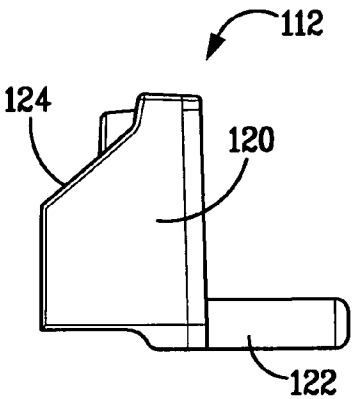
Figure 49:
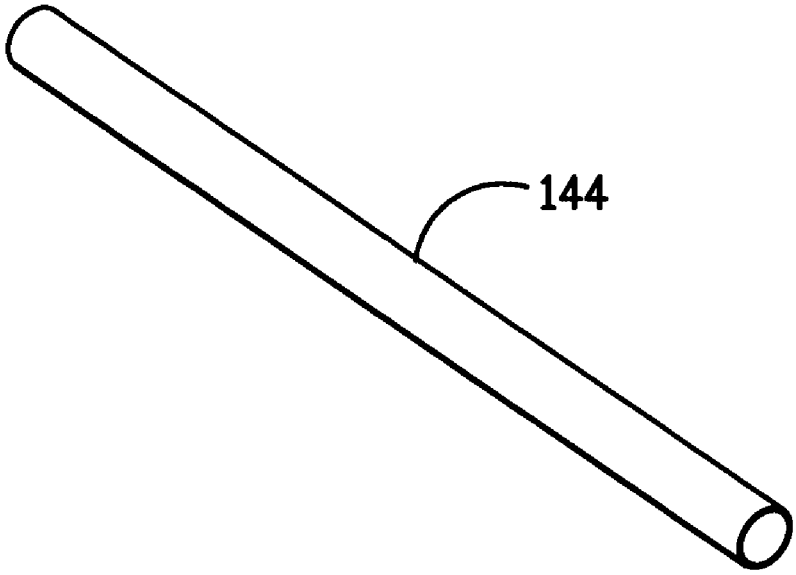
FIGS. 49-50 are views of the pivot pin the handle of a latch according to the present invention.
Figure 50:
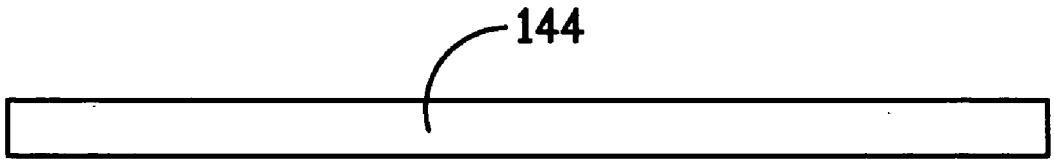
Figure 53:
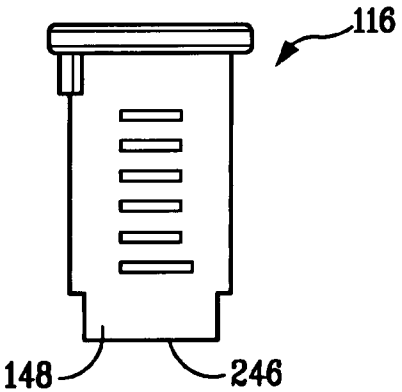
FIGS. 51-56 are views of the lock plug used with a latch according to the present invention.
Figure 56:
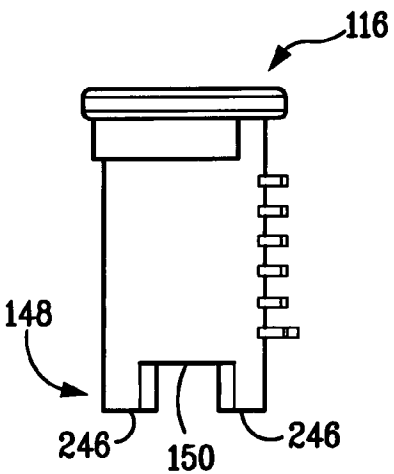
Figure 52:
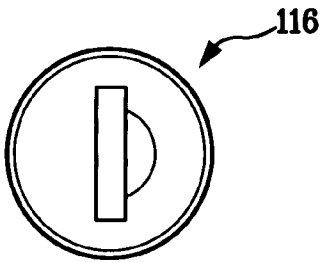
Figure 55:
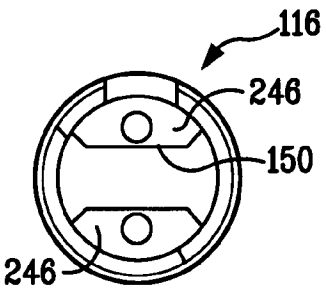
Figure 51:
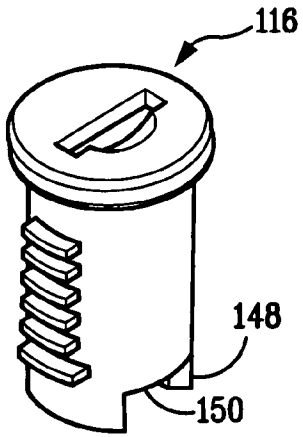
Figure 54:
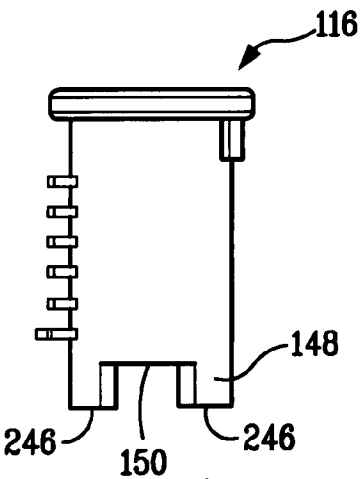
Figure 59:
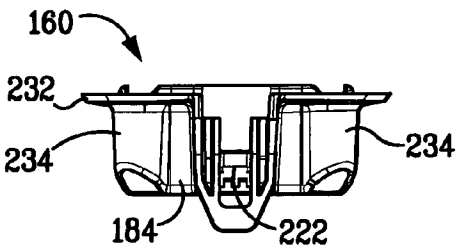
FIGS. 57-62 are views of the housing of the latch module of a latch according to the present invention.
Figure 62:
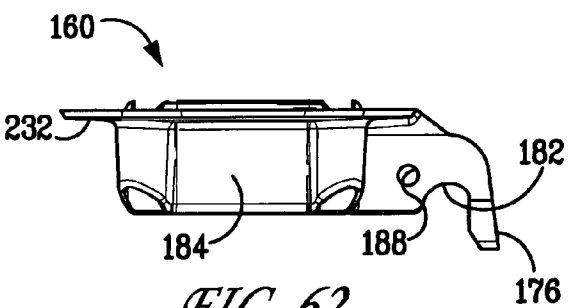
Figure 58:
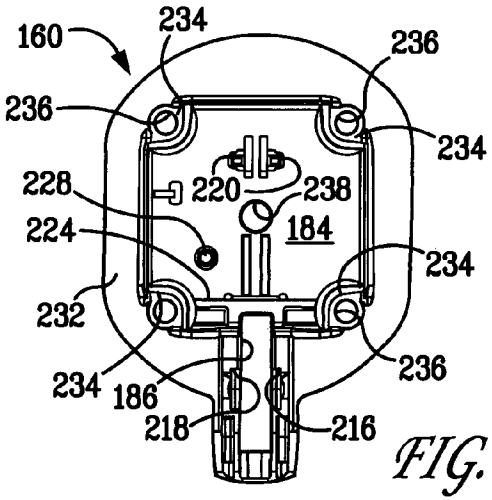
Figure 61:
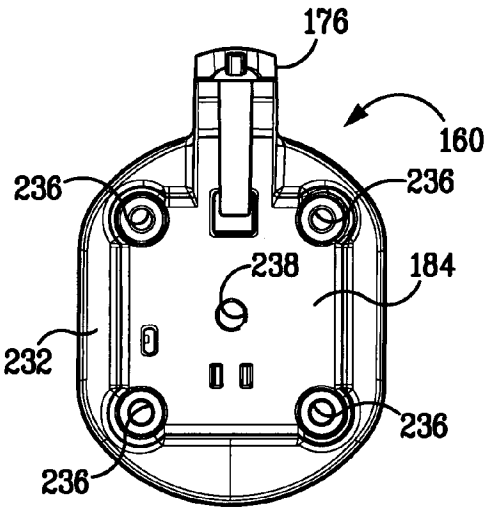
Figure 57:
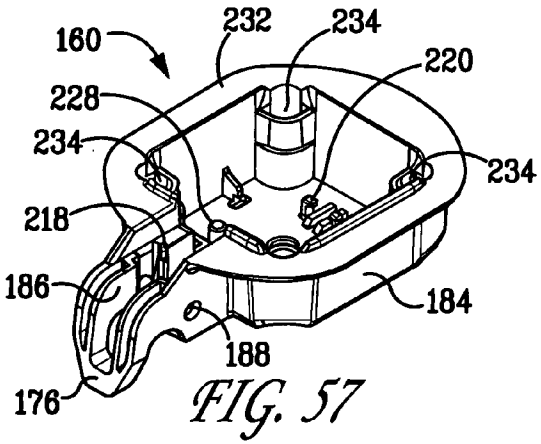
Figure 60:
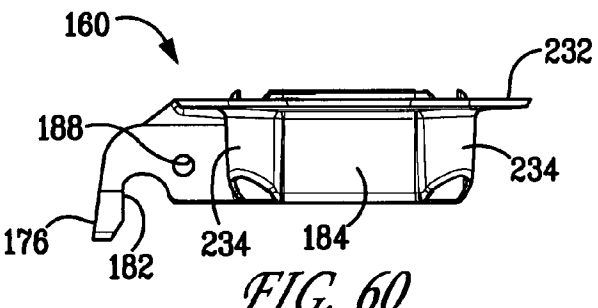
Figure 64:
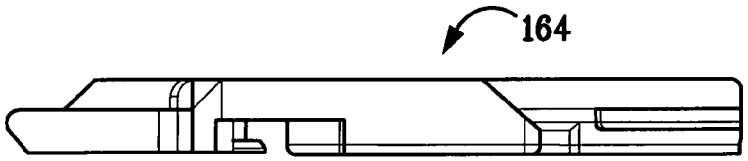
FIGS. 63-68 are views of the catch member of the latch module of a latch according to the present invention.
Figure 65:
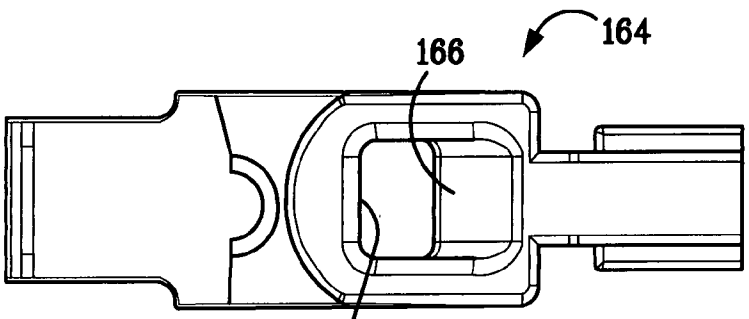
Figure 68:
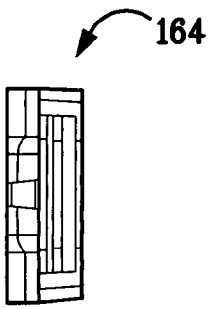
Figure 67:
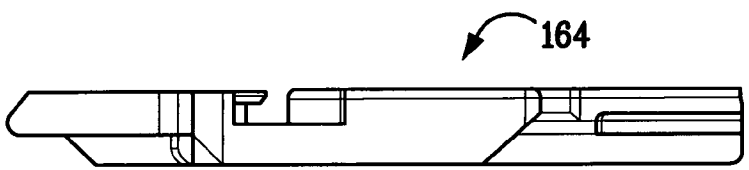
Figure 63:
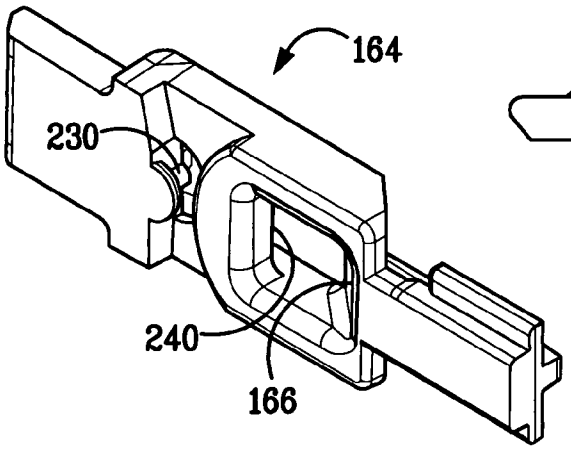
Figure 66:
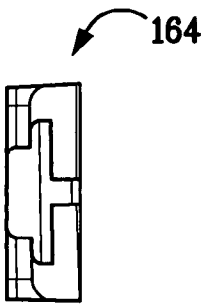
Figure 69:
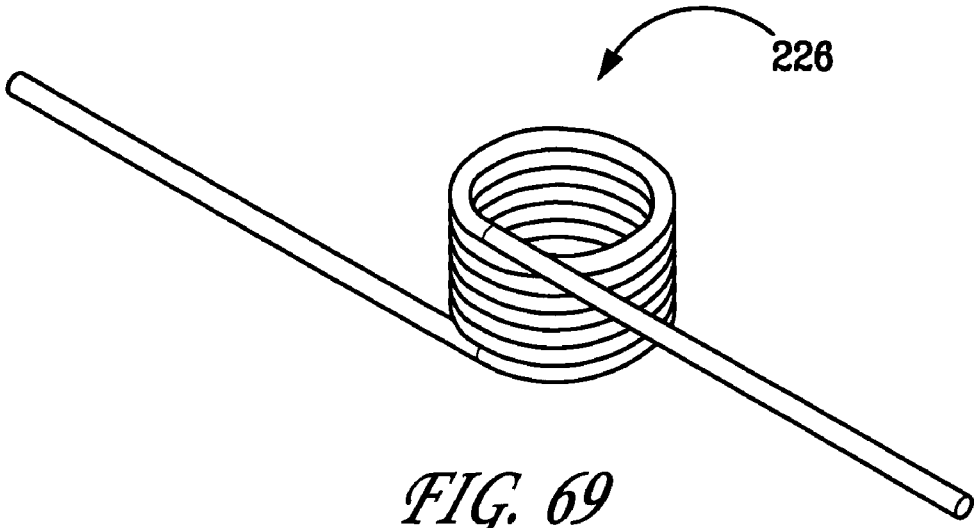
FIG. 69 is a perspective view of a torsion spring of the latch module of a latch according to the present invention.
Figure 70:
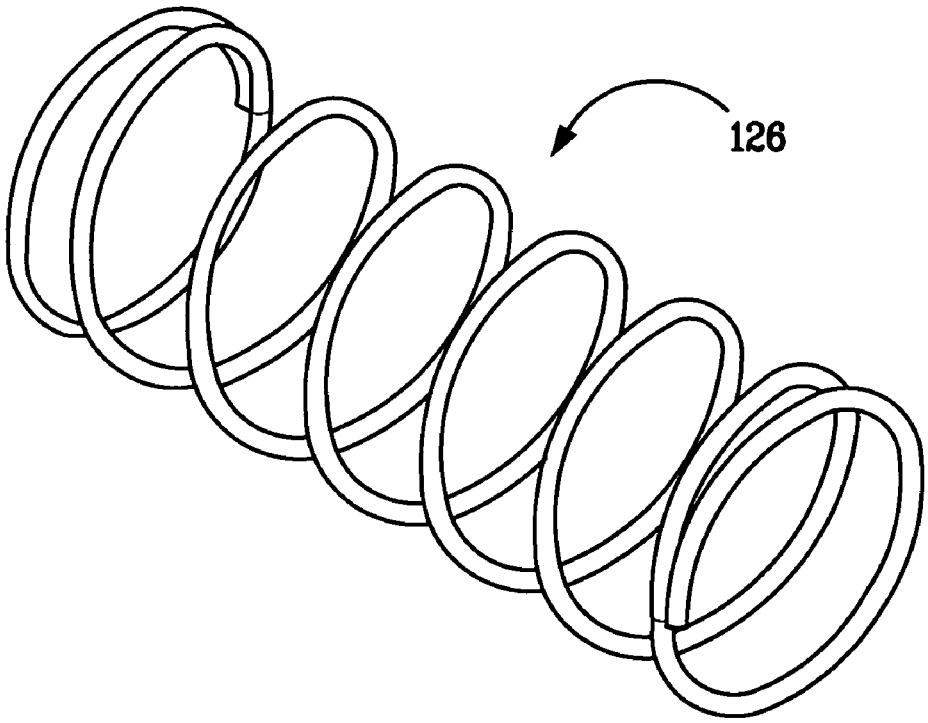
FIG. 70 is a perspective view of a compression spring of the actuator module of a latch according to the present invention.
Figure 73:
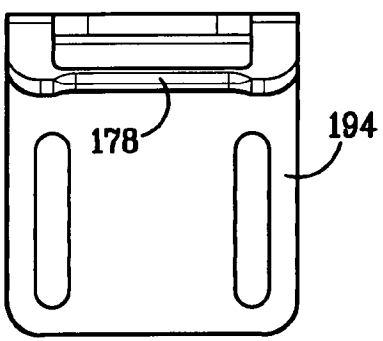
FIGS. 71-76 are views of the keeper rod for use with a latch according to the present invention.
Figure 76:
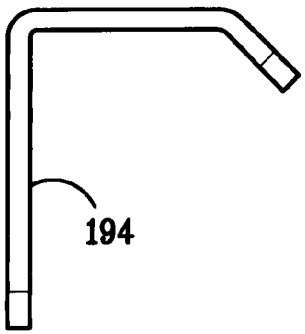
Figure 72:
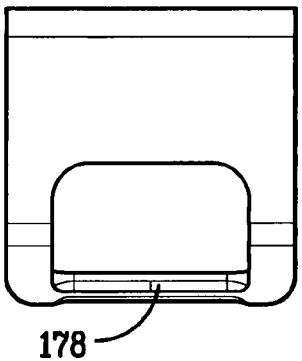
Figure 75:
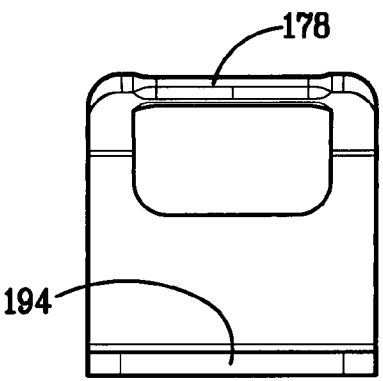
Figure 71:
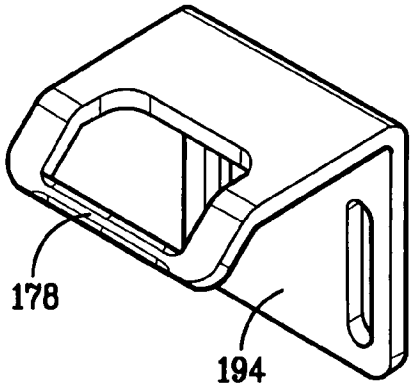
Figure 74:
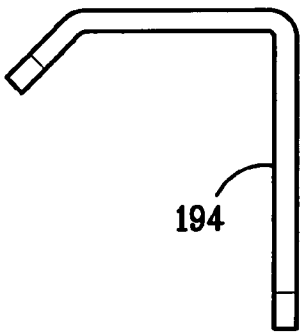
Figure 77:
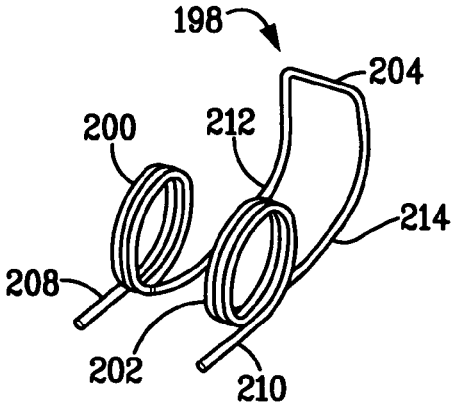
FIGS. 77-79 are views of the torsion spring for biasing the pawl of a latch according to the present invention.
Figure 79:
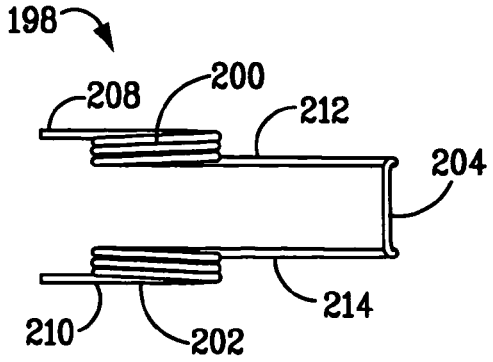
Figure 78:
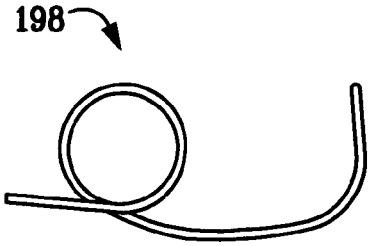
Figure 80:
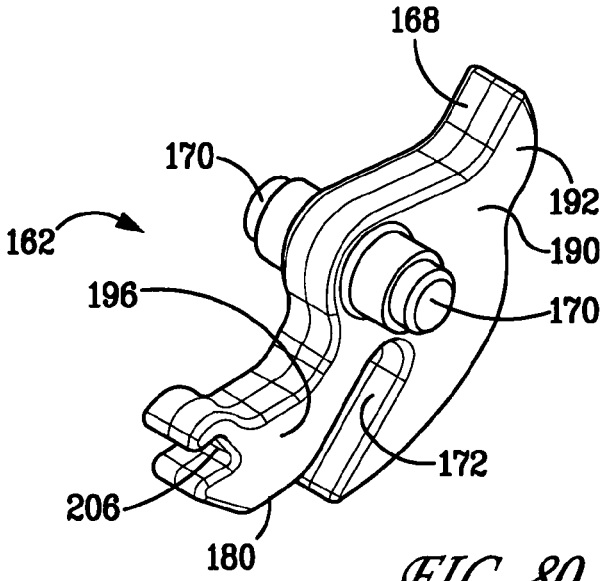
FIGS. 80-81 are views of the pawl of a latch according to the present invention.
Figure 81:
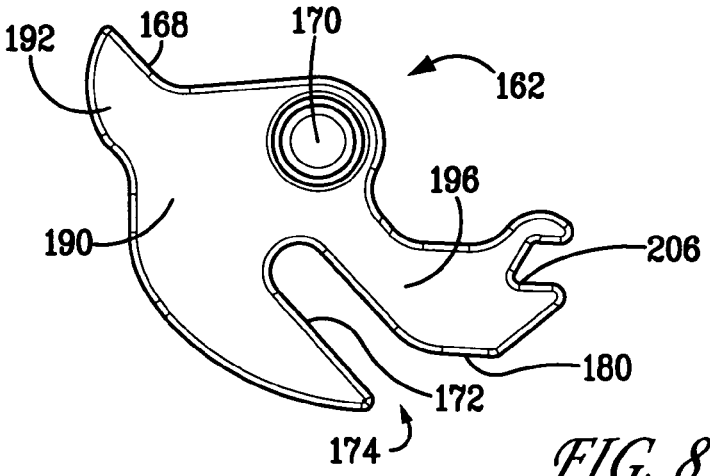
Figure 82:
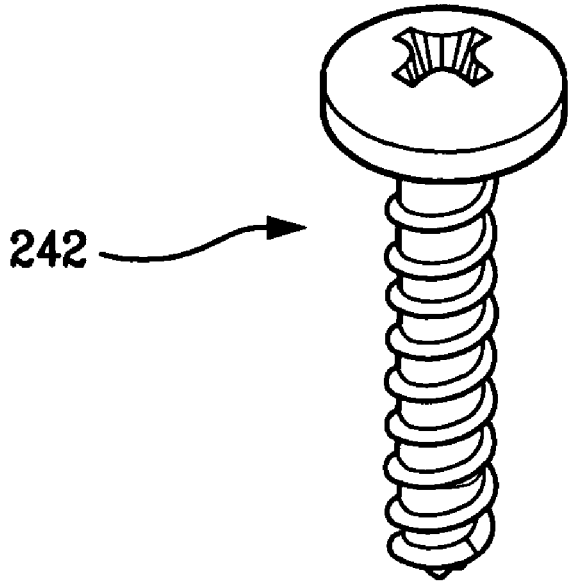
FIGS. 82-83 are views of a screw for securing the modules of a latch according to the present invention together.
Figure 83:
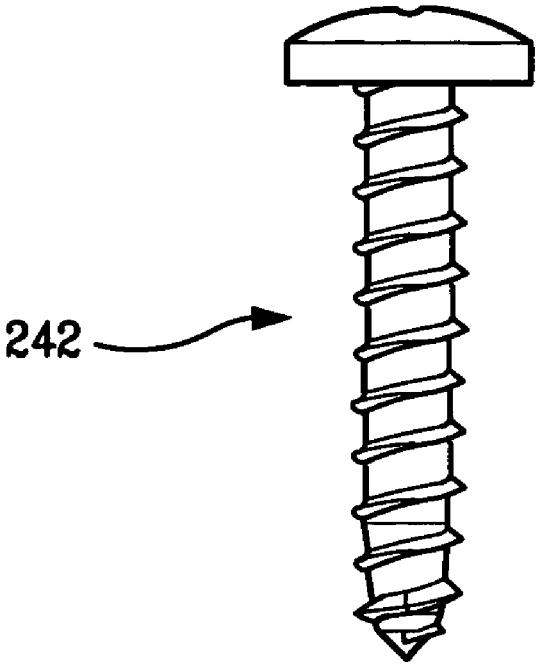
Figure 91:
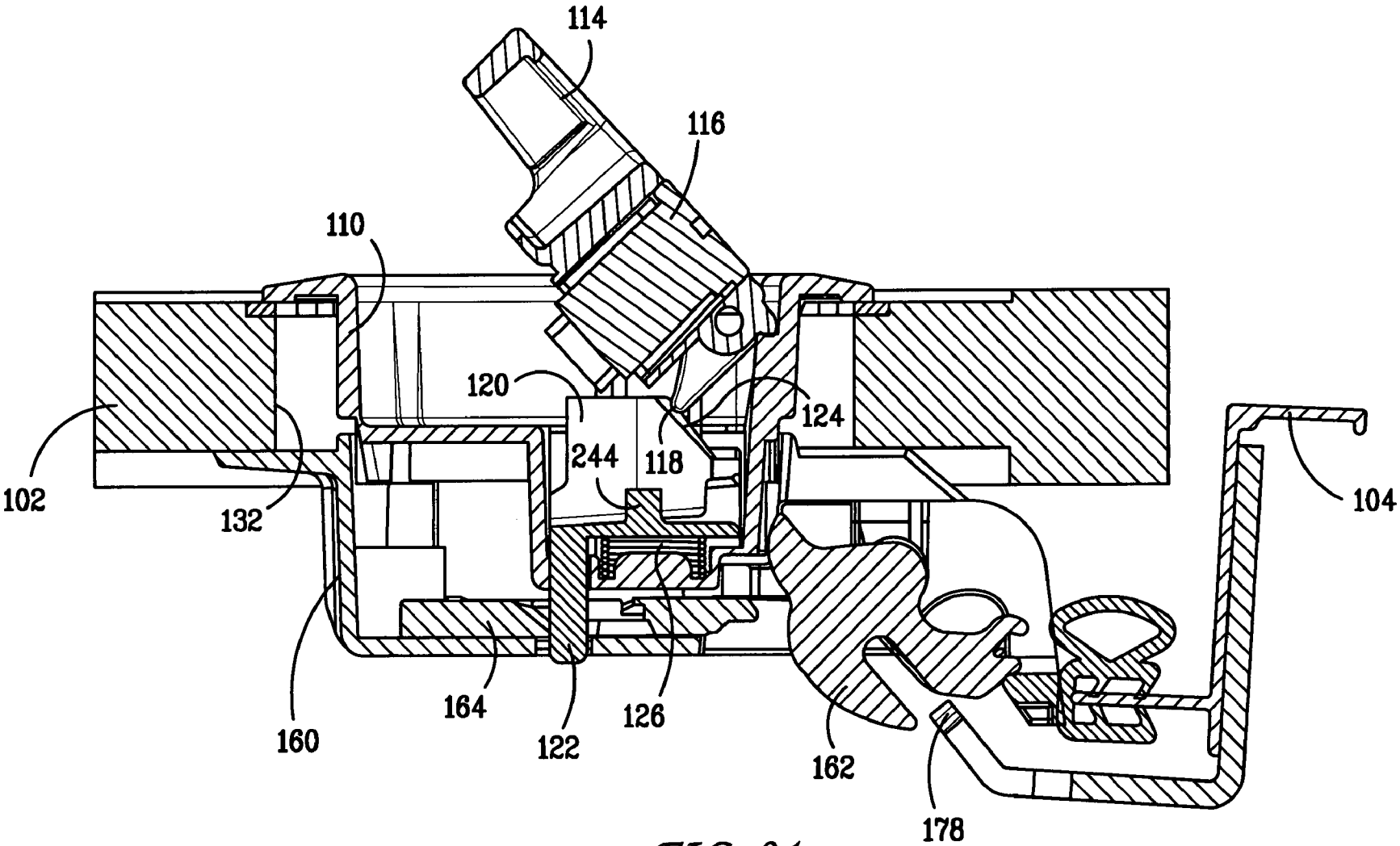
FIG. 91 is a cross sectional view of a latch according to the present invention shown with the handle raised and the pawl in the unlatched position and with the lock plug unlocked.
Figure 94:
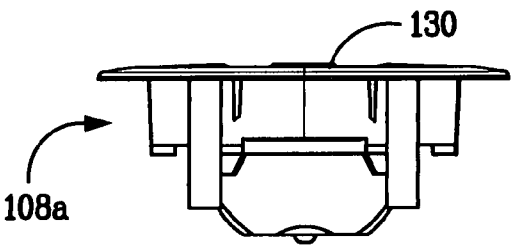
FIGS. 92-96 are views of a second embodiment of an actuator module for use with the latch according to the present invention shown with the handle in the folded-down position.
Figure 93:
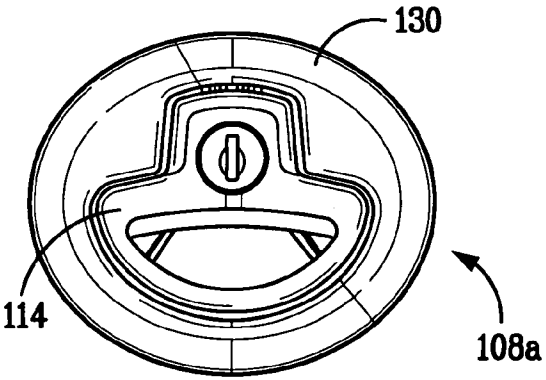
Figure 92:
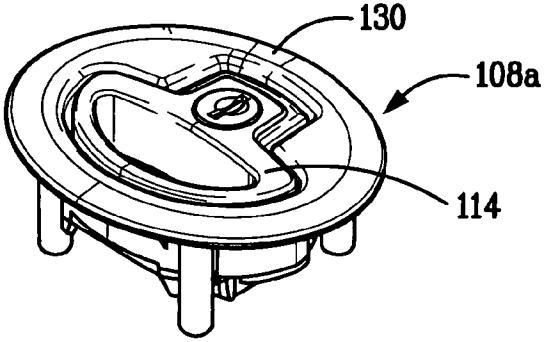
Figure 96:
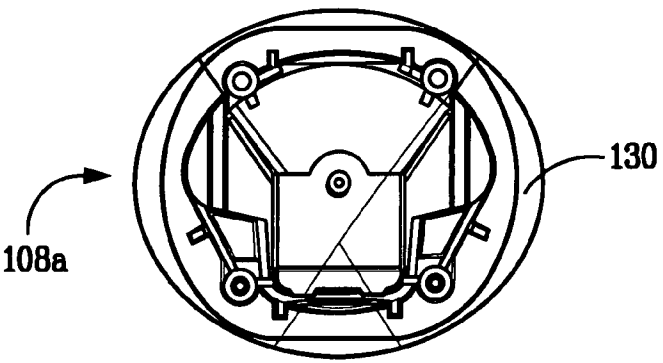
Figure 95:
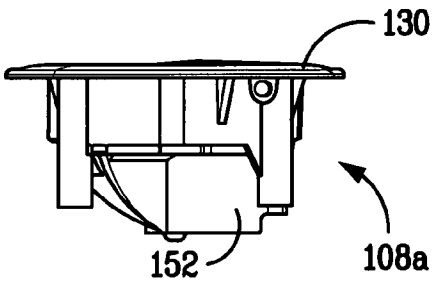
Figure 99:
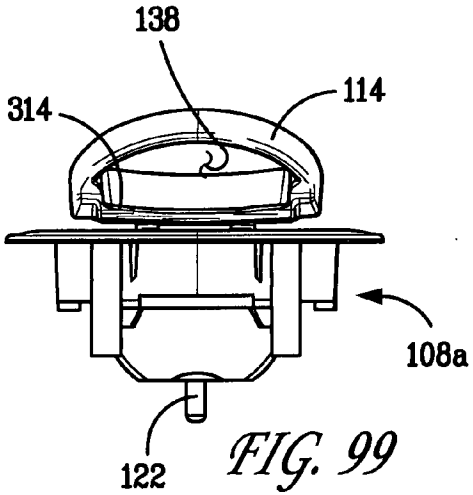
FIGS. 97-101 are views of a second embodiment of an actuator module for use with the latch according to the present invention shown with the handle in the raised position.
Figure 98:
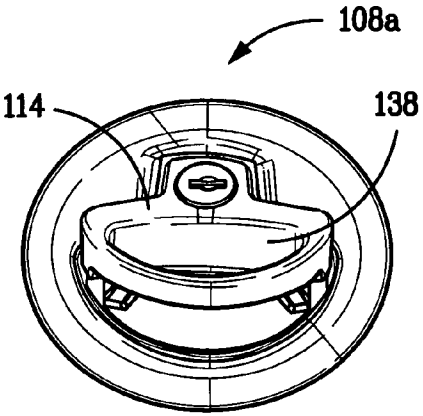
Figure 97:
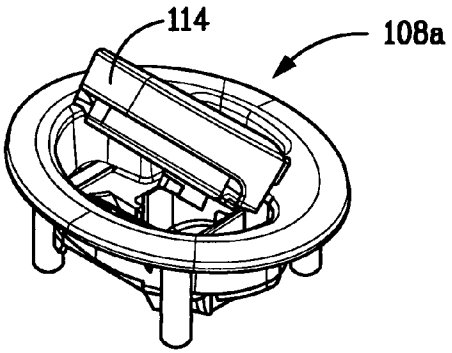
Figure 101:
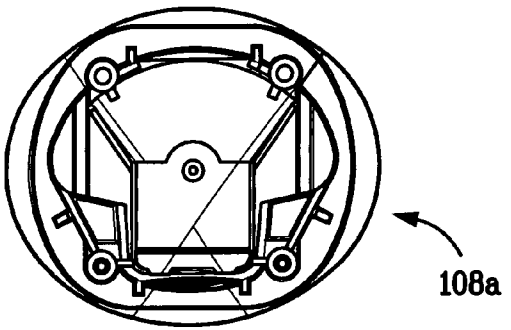
Figure 100:
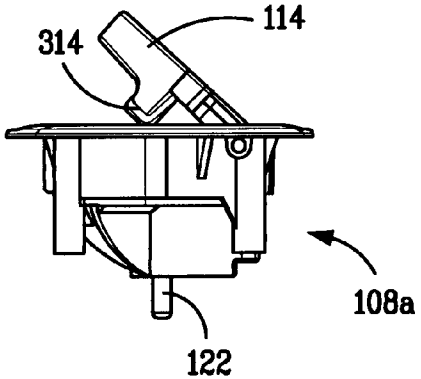
Figure 104:
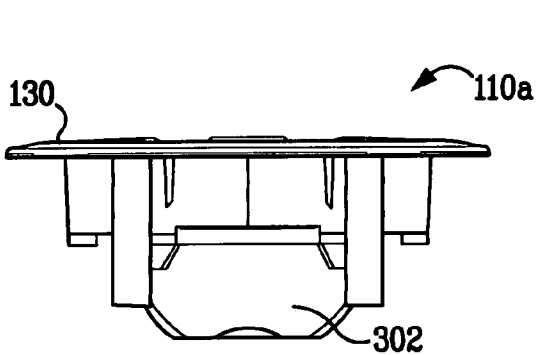
FIGS. 102-106 are views of the housing of the second embodiment of the actuator module for use with the latch according to the present invention.
Figure 103:
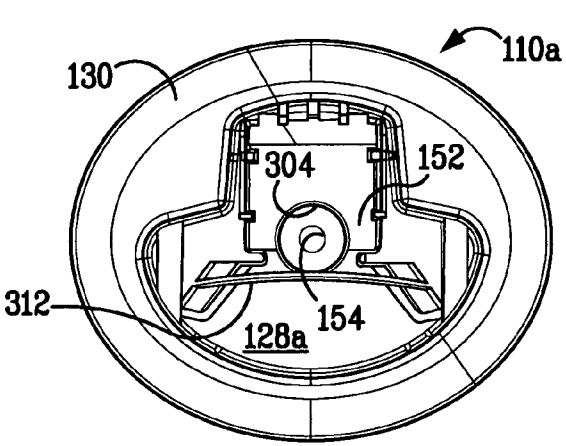
Figure 102:
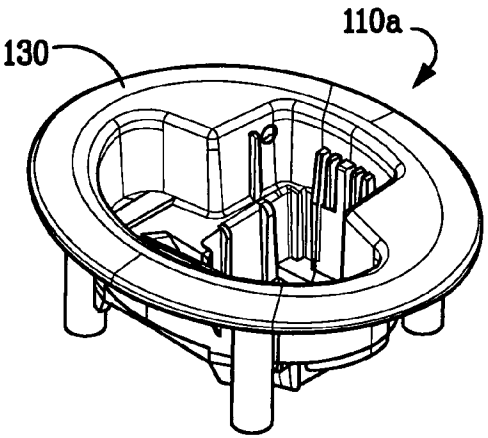
Figure 106:
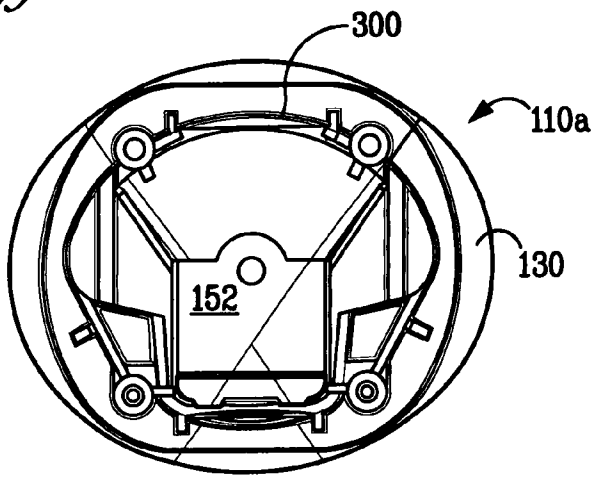
Figure 105:
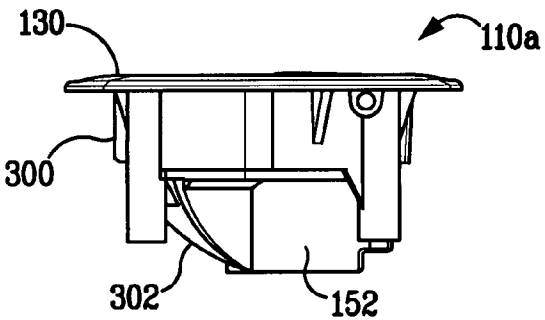
Figure 107:
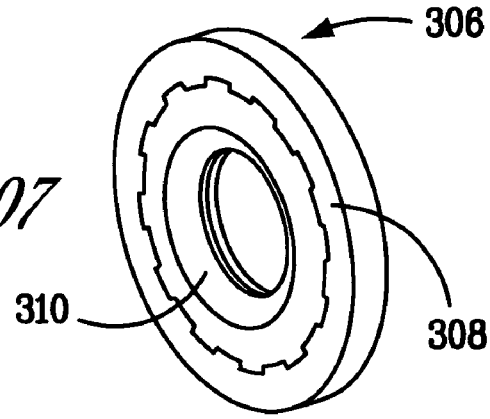
FIGS. 107-109 are views of the sealing washer of the second embodiment of the actuator module for use with the latch according to the present invention.
Figure 108:
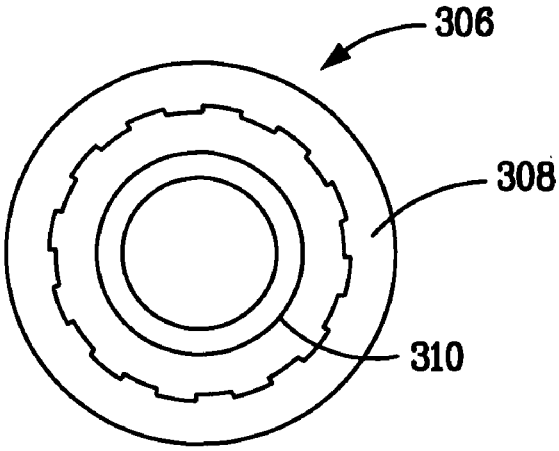
Figure 109:
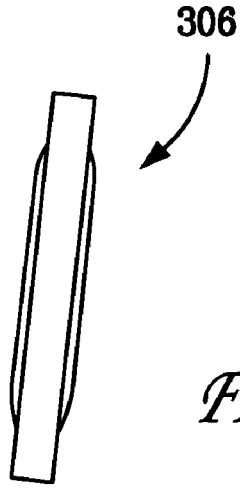
Figure 110:
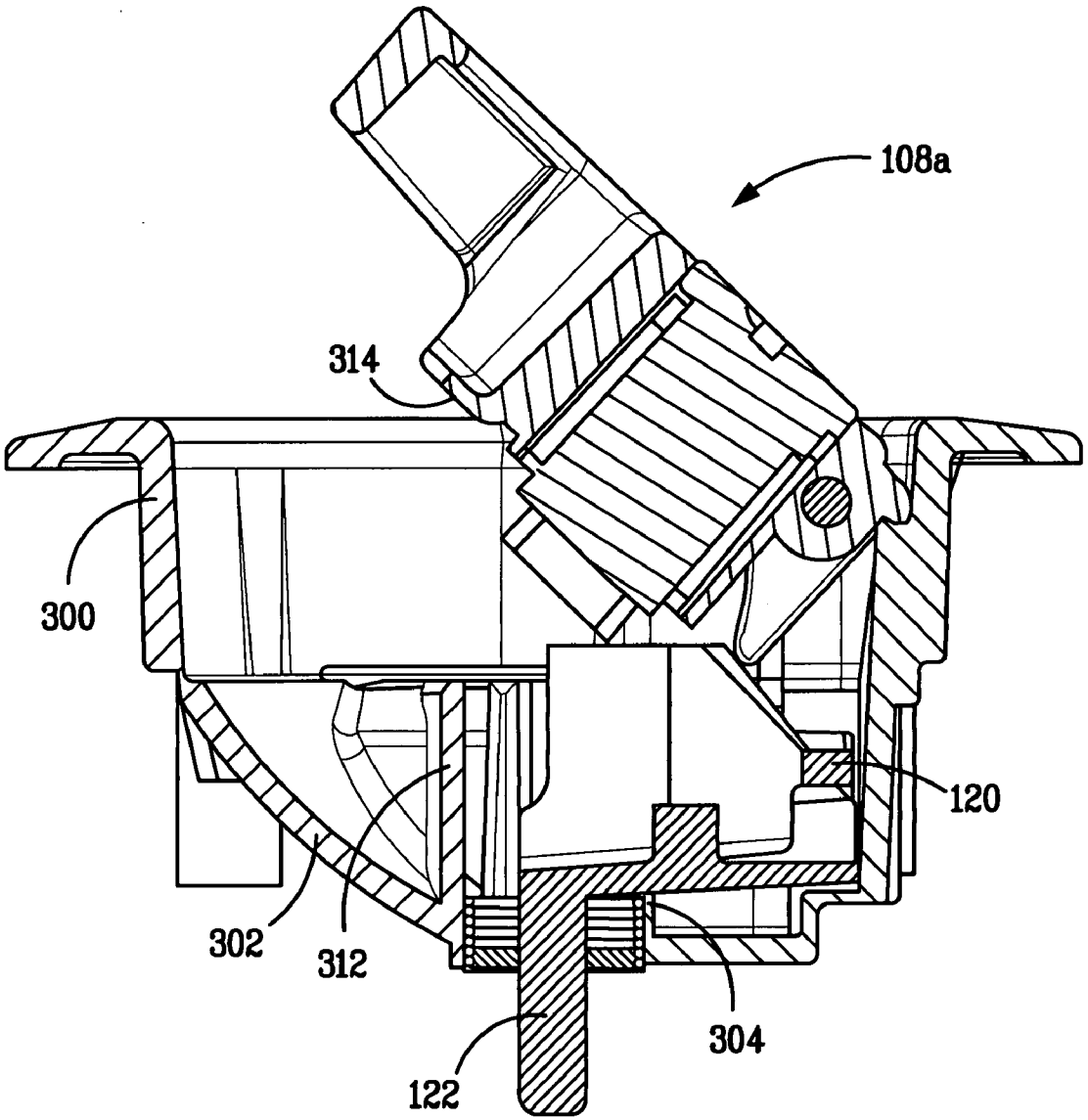
FIG. 110 is a cross sectional view of the second embodiment of the actuator module for use with the latch according to the present invention.
Figure 111:
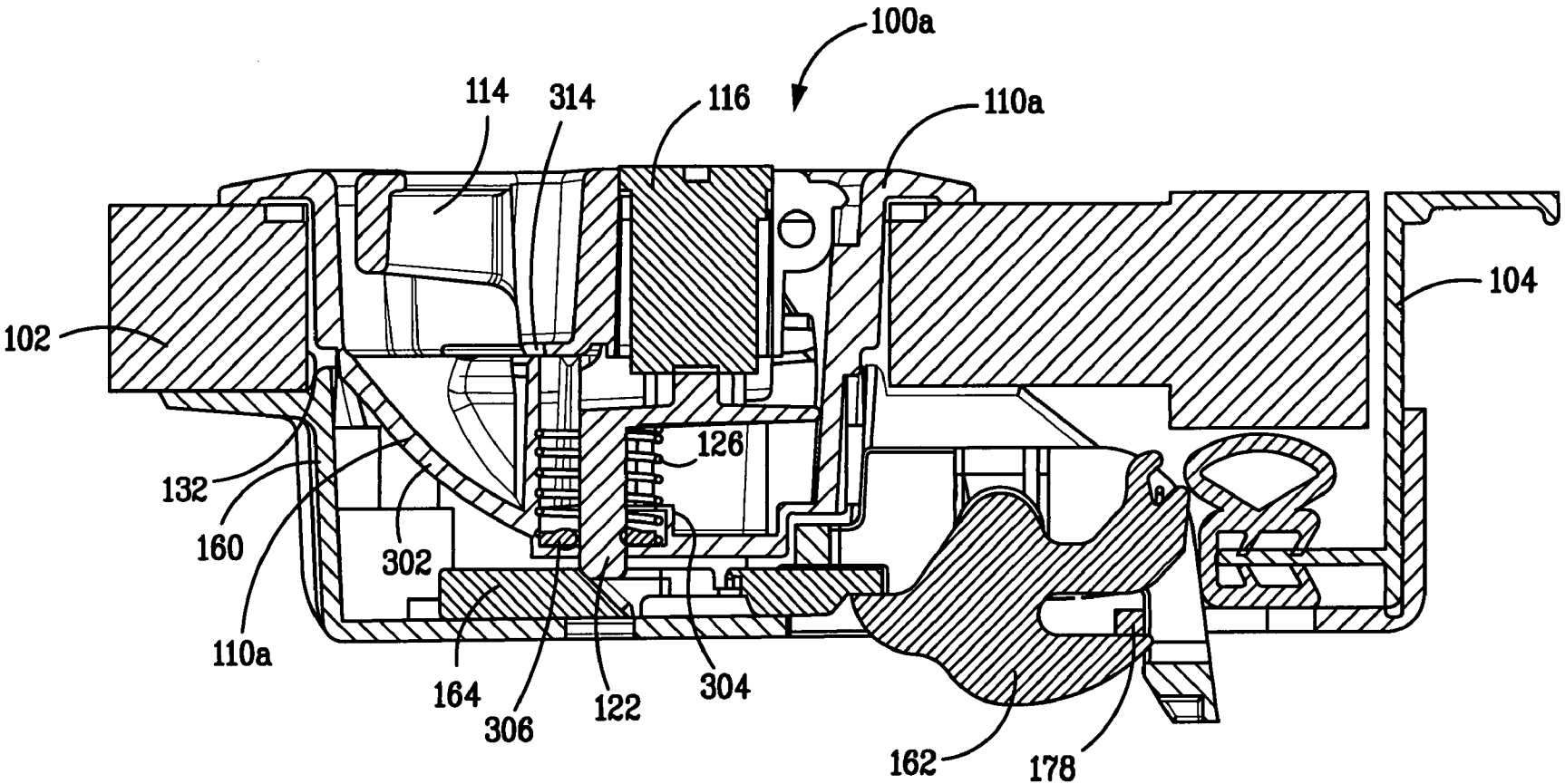
FIG. 111 is a cross sectional view of a latch according to the present invention employing the second embodiment of the actuator module.

Referring to FIGS. 1-91, the present invention is directed to a latch that is particularly suited for releasably securing a first member relative to a second member. For example, the latch of the present invention can be used to releasably secure a door against a doorframe. An illustrative embodiment 100 of the latch of the present invent is shown in the drawing figures. In the illustrative embodiment, the latch 100 is used to secure the door 102 against a doorframe 104. However, the latch 100 could easily have been installed to the doorframe and engaged a keeper attached to the door to securely hold the door in the closed position.

Figure 84:
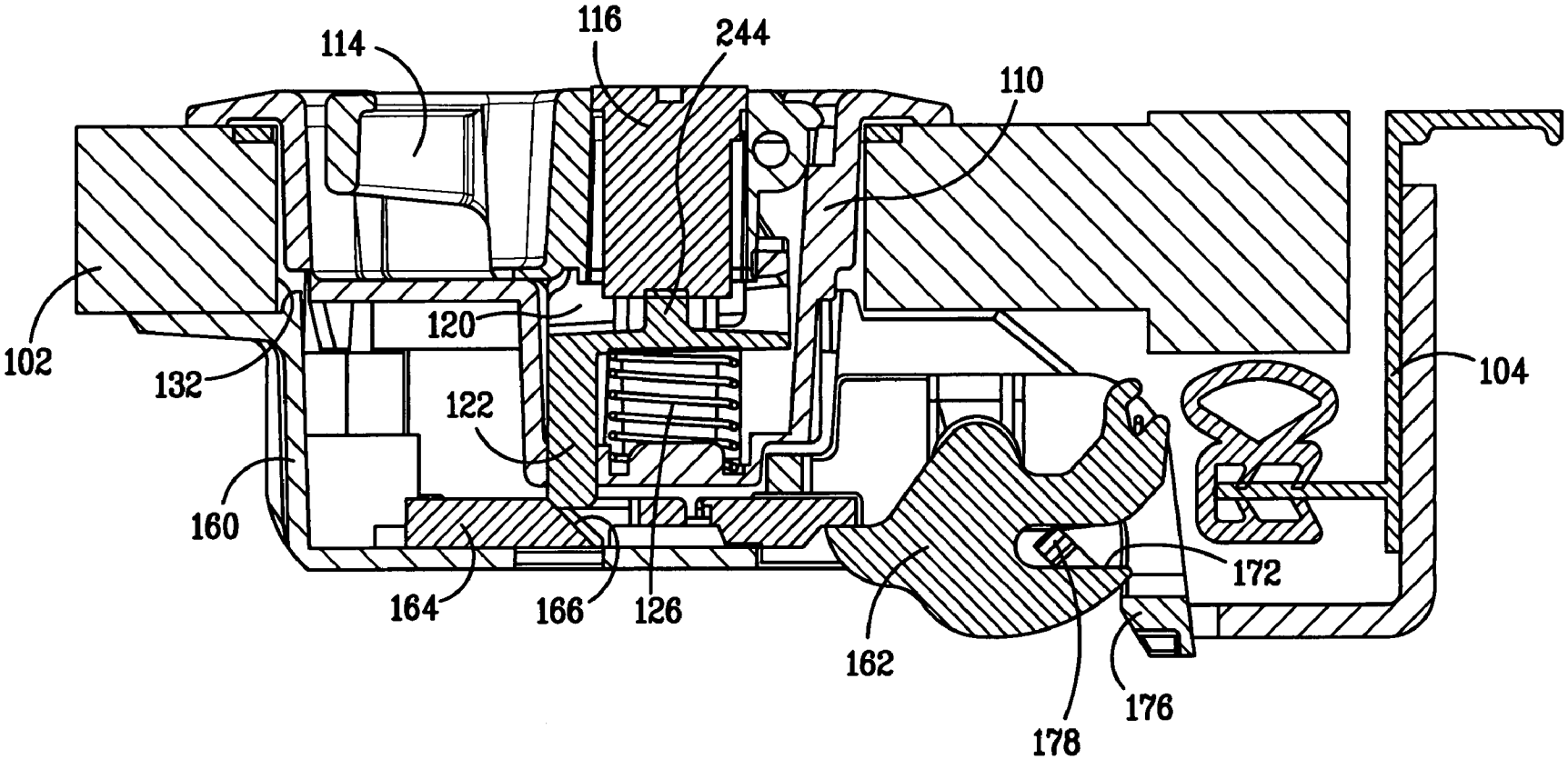
FIG. 84 is a cross sectional view of a latch according to the present invention shown with the handle folded down and the pawl in the latched position but with the lock plug unlocked.
Figure 85:
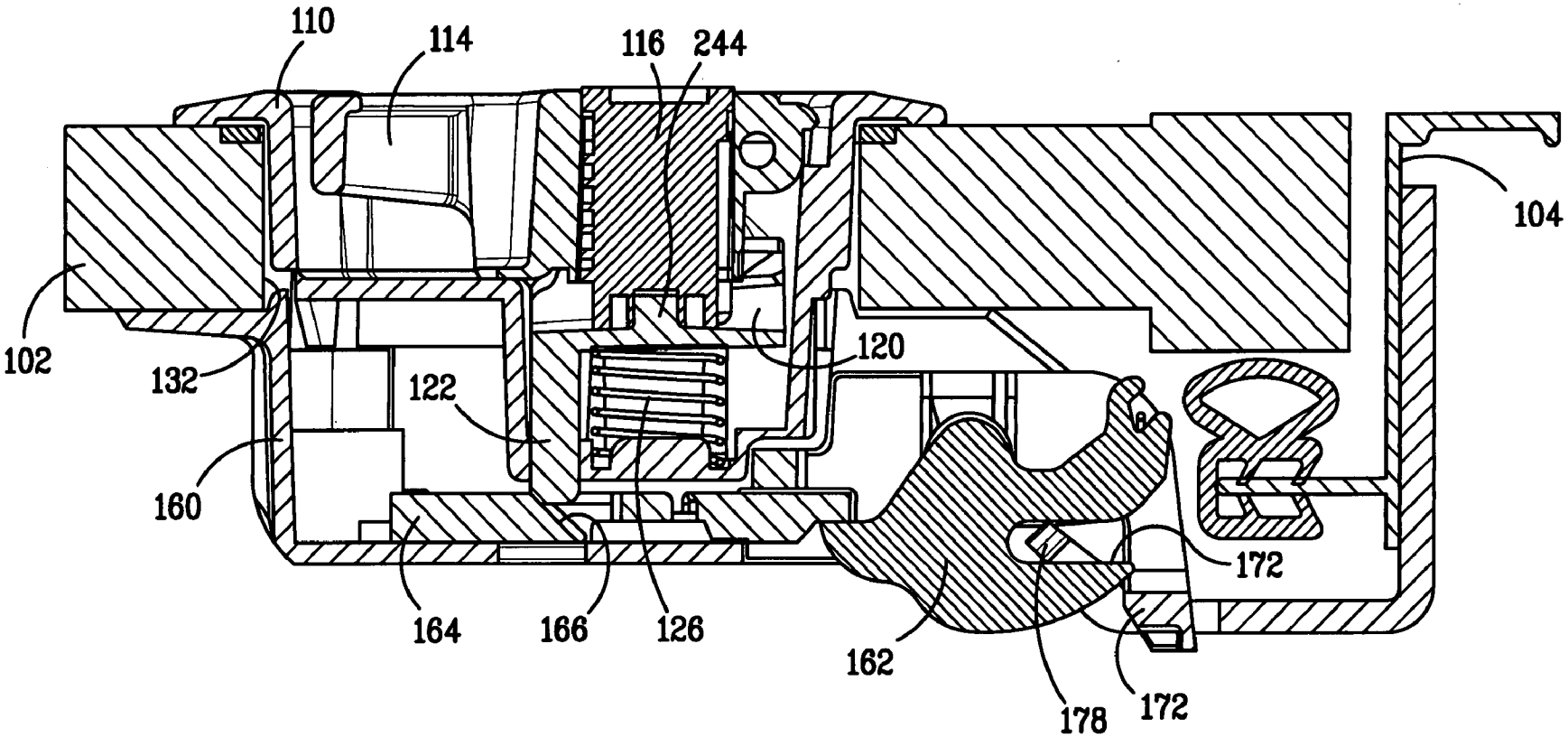
FIG. 85 is a cross sectional view of a latch according to the present invention shown with the handle folded-down and the pawl in the latched position but with the lock plug locked.
Figure 86:
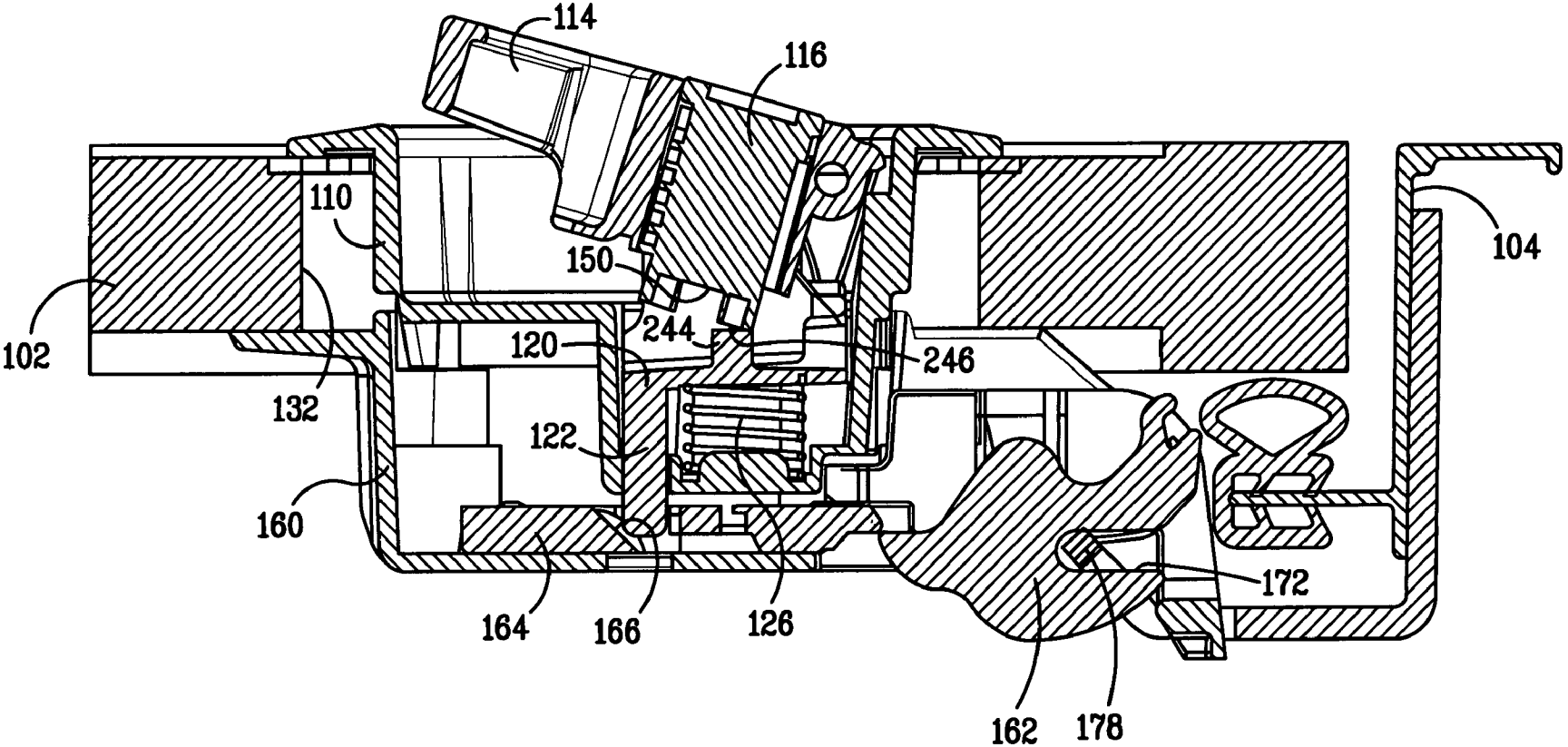
FIG. 86 is a cross sectional view of a latch according to the present invention shown with the handle in an intermediate position but with the pawl in the latched position and the lock plug locked.
Figure 88:
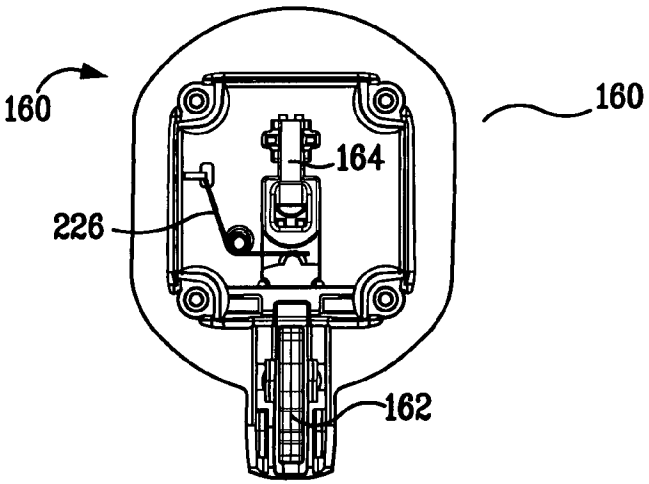
FIGS. 87-88 are views of the latch module of a latch according to the present invention showing the pawl in the latched position.
Figure 90:
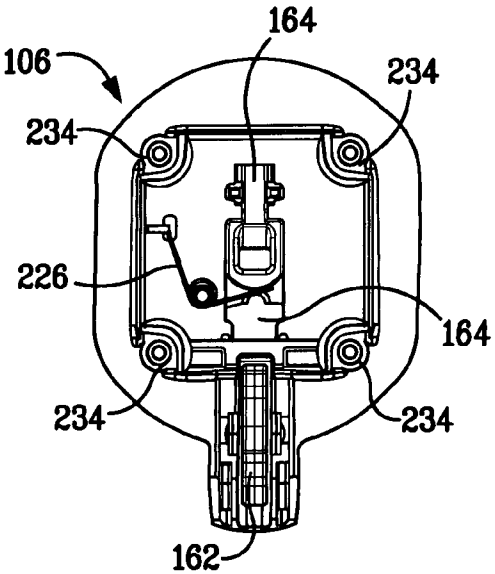
FIGS. 89-90 are views of the latch module of a latch according to the present invention showing the pawl in the unlatched position.
Figure 87:
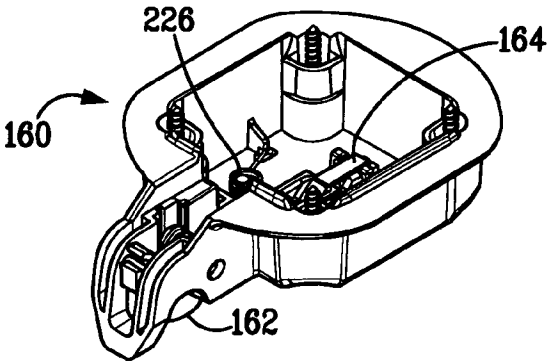
Figure 89:
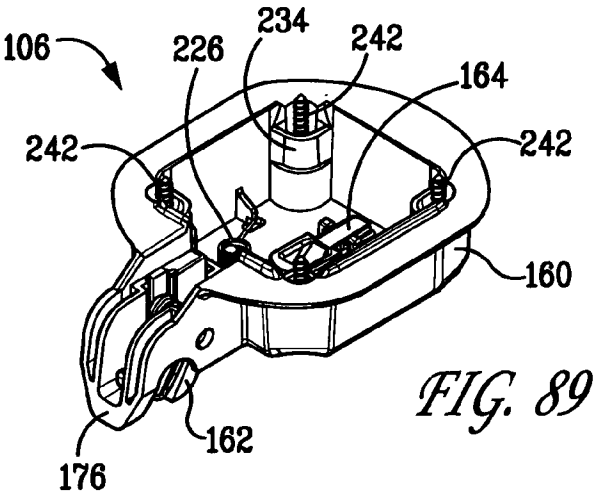

The latch 100 includes a latch module 106 and an actuator module 108. The latch module 106 includes at least a portion of a latching mechanism such as that which will be described later in reference to the illustrative embodiment. The actuator module 108 includes a first housing 110, an actuating member 112, a handle 114, and a lock plug 116. The handle 114 is pivotally attached to the first housing 110. The handle 114 moves pivotally between a raised position as shown in FIG. 91 and a folded-down position as shown in FIG. 84. The handle 114 is provided with cam surfaces 118. The actuating member 112 includes a base 120 and a post member 122 that projects from the bottom of the base 120. The post member 122 has a longitudinal axis that also defines the longitudinal axis of the actuating member 112. The actuating member 112 is supported by the first housing 110 for linear movement directed along the longitudinal axis of the post member 122 of the actuating member 112. The base 120 is provided with cam surfaces 124 that register with the cam surfaces 118 of the handle 114. In the fully assembled actuator module 108 the actuating member 112 moves linearly along an imaginary axis coincident with the longitudinal axis of the post member 122 in response to the handle 114 moving between the raised position and the folded-down position.

The actuating member 112 moves linearly between an extended position illustrated in FIG. 91 and a retracted position illustrated in FIG. 84. The cam surfaces 118 of the handle 114 engage the cam surfaces 124 of the base 120 to move the actuating member 112 linearly along the imaginary axis, which is coincident with the longitudinal axis of the post member 122, from a retracted position to an extended position as the handle 114 is pivotally moved from the folded-down position to the raised position.

A coil spring 126 is placed intermediate the base 120 of the actuating member 112 and the bottom of the first housing 110. The coil spring 126 biases the actuating member 112 toward the retracted position and into engagement with the handle 114 such that the cam surfaces 124 are maintained in engagement with the cam surfaces 118 over at least a portion of the range of motion of the handle 114. Preferably, the coil spring 126 maintains the cam surfaces 124 in engagement with the cam surfaces 118 over the full range of motion of the handle 114 between the folded-down position and the raised position. The spring 126 acting through the actuating member 112 also biases the handle 114 toward the folded-down position such that when the handle 114 is released while in the raised position, the handle 114 tends to return to the folded-down position. Furthermore, the handle 114 returns to the folded-down position as the actuating member 112 returns to the retracted position.

The first housing 110 has a cup-like portion 128 designed to receive the latch handle 114 when the latch handle 114 is in the folded-down position. The cup-like portion 128 has an open top that is surrounded by a first flange or bezel 130. The first housing 110 is adapted to be mounted in an opening 132 in the door 102 such that the cup-like portion 128 passes into the opening 132 and the flange 130 abuts the exterior surface of the door adjacent the opening 132. The first housing 110 projects to only a small height above the exterior surface of the door 102 when the latch 100 is mounted in the door. This small height is roughly equivalent to the thickness of the flange or bezel 130 that surrounds the open top of the cup-like portion 128 of the first housing 110. In the illustrated embodiment, the opening 132 is formed in a slight depression in the exterior of the door 102, and therefore the projection of the first housing 110 above the exterior surface of the door is even less than the thickness of the flange or bezel 130. Desirably, the latch handle 114 is substantially flush with the flange or bezel 130 of the cup-like portion 128 of the first housing 110 when the latch handle 114 is in the folded-down position. In the latch 100, the latch handle 114 can be folded down to be substantially flush with the flange or bezel 130 of the cup-like portion 128 of the first housing 110. The cup-like portion 128 of the first housing 110 is sized and shaped to correspond at least with key portions of the outline of the latch handle 114 in plan view.

The handle 114 has a stem 134 extending from an approximately D-shaped portion 136 that together give the handle 114 an approximately mushroom shape in plan view. The D-shaped portion 136 has a corresponding approximately D-shaped opening 138 that allows a user to insert one or more fingers in the opening 138 in order to grasp the handle 114 and move it to the raised position. This handle design also provides an efficient pull handle for pulling the door 102 open. The open top of the cup-like portion 128 is shaped to correspond to the outline of the handle 114 in plan view. The stem 134 has a hole 140 passing therethrough. The hole 140 registers with holes 142 in the first housing 110. A pivot pin 144 passes through the hole 140 and the holes 142 to pivotally attach the handle 114 to the housing 110. The pivot pin 144 is preferably of the roll pin type, i.e. a pin made by rolling up a flat sheet of metal. In the illustrated embodiment, the pin 144 frictionally engages the hole 140 and is free to rotate in the holes 142. The opposite arrangement would also work, i.e. the pin 144 could frictionally engage the holes 142 and be free to rotate in the hole 140.

An approximately cylindrical lock plug housing 146 is formed in the stem 134 of the handle 114. The lock plug housing 146 is adapted to receive the lock plug 116. The lock plug 116 is received in the lock plug housing 146 in the fully assembled actuator module 108. The lock plug 116 is of a well-known type and will not be described here in detail. In the locked configuration, a series of tabs projecting from the side of the lock plug 116 engage a recess in the wall of the lock plug housing 146 to keep the lock plug 116 from rotating. When the appropriate key is inserted in the lock plug 116, the tabs are retracted into the lock plug to allow the lock plug to be rotated between the locked and unlocked positions by turning the key. The lock plug 116 is retained in the lock plug housing 146 with a retaining wafer. The bottom end 148 of the lock plug, i.e. the end opposite the end having the keyhole, has a slotted or channel configuration and is provided with a channel 150 that is open at both ends.

Projecting from the bottom of the cup-like portion 128 is a hollow box-like receptacle 152 that has a top opening that is coincident with an opening in the bottom of the cup-like portion 128. A round opening 154 is provided in the bottom of the receptacle 152. The opening 154 is sized to provide clearance for the post member 122 of the actuating member 112. The receptacle 152 houses the spring 126, at least a portion of the base 120 and at least a portion of the post member 122. As the actuating member moves to the extended position more of the base 120 is received within the receptacle 152 and the post member 122 projects outward to a greater extent from the bottom of the receptacle 152. In the extended position, the extent of projection of the post member 122 outward from the bottom of the receptacle 152 is at its maximum. In the retracted position, the extent of projection of the post member 122 outward from the bottom of the receptacle 152 is at its minimum.

Extending downward from the flange 130 are a plurality of cylindrical sleeves 156. Each cylindrical sleeve 156 has a hole 158 that is coaxial with the longitudinal axis of the respective cylindrical sleeve 156. The plurality of holes 158 are distributed evenly around the post member 122 with each hole 158 being equidistant from the longitudinal axis of the post member 122. Thus, the holes 158 are distributed evenly along a circular arc having a center through which the longitudinal axis of the post member 122 passes. In the illustrated embodiment there are four holes 158 at 90° intervals.

In the illustrative embodiment, the latch module 106 includes a second housing 160, a pawl 162, and a catch member 164. The pawl 162 is supported by the second housing 160 for rotary movement between the latched position shown in FIG. 84 and the unlatched position shown in FIG. 91 relative to the second housing 160. The pawl 162 is spring biased toward the unlatched position. The catch member 164 is linearly movable relative to the housing 160 between the engaged position shown in FIG. 84 and the disengaged position shown in FIG. 91 and is spring biased toward the engaged position. The catch member 164 maintains the pawl 162 in the latched position when the pawl 162 is in the latched position and the catch member 164 is in the engaged position. The pawl 162 is released for rotational movement to the unlatched position under spring bias when the catch member 164 is moved to the disengaged position. The catch member 164 is provided with a ramp or inclined surface 166. The pawl 162 has a catch surface 168 that is engaged by the catch member 164 to retain the pawl 162 in the latched position when the pawl 162 is in the latched position and the catch member 164 is in the engaged position. The pawl 162 moves rotationally between the latched position and the unlatched position about an axis of rotation defined by two half shafts 170 projecting from either side of the pawl 162. The pawl 162 has a pawl slot 172 having an open end 174. The second housing 160 has a crook portion 176 that overhangs the axis of rotation of the pawl 162 such that the crook portion 176 obstructs the open end of the pawl slot 172 when the pawl 162 is in the latched position as shown in FIG. 84. The open end of the pawl slot 172 is positioned for unobstructed access from at least one direction by a keeper rod 178 when the pawl 162 is in the unlatched position as shown in FIG. 91. The pawl 162 has a cam surface 180 that defines one side of the open end of the pawl slot 172. The cam surface 180 at the open end of the pawl slot 172 is impacted by the keeper rod 178 to thereby initiate rotation of the pawl 162 from the unlatched position toward the latched position. Further engagement of the keeper rod 178 with the pawl slot 172 causes further rotation of the pawl 162 toward the latched position as the first member, the door 102 in this example, is moved to the closed position relative to the second member, the doorframe 104 in this example. Thus, the movement of the pawl 162 to the latched position is accomplished by moving the first member, the door 102 in this example, to the closed position relative to the second member, the doorframe 104 in this example.

In the fully assembled latch 100 the actuating member 112 is adapted to selectively engage the catch member 164 to thereby move the catch member 164 to the disengaged position. In the illustrated embodiment, the post member 122 of the actuating 112 member engages the inclined surface 166 to move the catch member 164 from the engaged position to the disengaged position as the actuating member 112 is moved linearly from the retracted position to the extended position in response to movement of the handle 114 from the folded-down position to the raised position. Due to the angle of the inclined surface 166 relative to the longitudinal axis of the post member 122, the force exerted by the post member of the actuating member 112 on the inclined surface 166 of the catch member 164 results in a force component in the direction of the linear movement of the catch member 164 that forces the catch member 164 toward and ultimately to the disengaged position. In this way, the pawl 162 is released from the latched position when the handle 114 is moved from the folded-down position to the raised position.

The housing 160 has a crook portion 176 that closes off the open end of the pawl slot 172 when the pawl 162 is in the latched position. Furthermore, the housing 160 is adapted to allow an unobstructed path for the keeper rod 178 to the open end of the pawl slot 172 when the pawl 162 is in the unlatched position. In the illustrated embodiment, the housing 160 has a crook portion 176 that is provided with an open U-shaped indentation or recess 182 as viewed in profile. The crook portion 176 is attached to a cup-like portion 184 of the housing 160. The lateral side of the U-shaped indentation 182 located farthest from the cup-like portion 184 acts to close off the open end of the pawl slot 172 when the pawl 162 is in the latched position. The open mouth of the U-shaped indentation 182 allows an unobstructed path to the pawl slot 172 when the pawl 162 is in the unlatched position. The U-shaped indentation 182 is sized such that the housing 160 will not interfere with the movement of the keeper rod 178 relative to the housing 160 as the pawl 162 is moved from the unlatched position to the latched position by contact with the keeper rod 178. The cup-like portion 184 of the housing 160 houses the catch member 164. A slot 186 is provided within the crook portion 176 of the housing 160. The slot 186 receives a portion of the pawl 162 and allows for the pawl 162 to be rotationally supported by the housing 160 while portions of the pawl 162 project into and overlap the U-shaped indentation 182, all without interference with the rotational movement of the pawl. The slot 186 continues through a portion of the wall and the bottom of the cup-like portion 184 of the housing 160 such that the portion of the pawl 162 including the catch surface 168 can move rotationally through the cup-like portion 184 where it can come into contact with the catch member 164 when necessary. This arrangement allows the pawl 162 to move rotationally relative to the housing 160 over its operational range of motion without interference from any part of the cup-like portion 184 of the housing 160.

The U-shaped indentation 182 is oriented such that the open mouth of the U-shaped indentation 182 is directed in a direction that is substantially perpendicular to the bottom of the cup-like portion 184 of the housing 160. In the illustrated embodiment, the longitudinal axis of the catch member 164 essentially lies in the plane of rotation of the pawl 162. The plane of rotation of the pawl 162 is defined as a plane to which the axis of rotation of the pawl 162 is perpendicular and that passes through the center of the pawl 162.

The pawl 162 is pivotally connected to the housing 160 with the half shafts 170, each of which passes through a respective one of the holes 188 provided in the crook portion 176 of the housing 160. The holes 188 pass through the crook portion 176 of the housing 160 on either side of the slot 186.

The pawl 162 has a body portion 190 to which the half shafts 170 are attached. The pawl 162 has a lug or projection 192 and is provided with a pawl slot 172 to retain the keeper rod 178 the pawl 162 is in the latched position. In the illustrated example, the keeper rod 178 has a mounting base 194 for mounting the keeper rod 178 to a member such as the doorframe 104. The keeper rod 178 has a rod or bar shape that engages the pawl slot 172 as the door 102 is moved to the closed position relative to the keeper rod 178 and the doorframe 104. When the door 102 is closed, the keeper rod 178 will be positioned or caught in the pawl slot 172 with the pawl 162 in the latched position. In this position the open end of the pawl slot 172 is closed off by the lateral side of the U-shaped indentation 182 distal from the cup-like portion 184 for added security. The pawl 162 is also provided with an arm portion 196 extending from the pawl body 190.

A pawl torsion spring 198 is installed on the pawl 162 with the coiled portions 200 and 202 surrounding a respective one of the half shafts 170 on either side of the pawl 162. The cross bar 204 of the torsion spring 198 engages the notch 206 in the arm portion 196. In the illustrated example the notch 206 is enlarged to more positively retain the cross bar 204 in position relative to the pawl 162. The torsion spring 198 also has first and second arms 208, 210 and third and fourth arms 212,214. The spring arms 212,214 extend from the respective coiled portions 200 and 202 of the torsion spring 198 and connect to cross bar 204 at either end thereof. The pawl arm 196 is positioned intermediate the spring arms 212 and 214. The projection or lug 192 carries the catch surface 168 that extends roughly in a radial direction relative to the pivot axis of the pawl 162.

The arms 208, 210 of the torsion spring 198 fit into and lie along the steps 216, 218, respectively, formed by a wider portion of the slot 186 in the area of the holes 188. With the arms 208, 210 of the torsion spring 198 positioned along the steps 216, 218, the cross bar 204 of the torsion spring 198 exerts a force on the arm portion 196 of the pawl 162 that biases the pawl 162 toward the unlatched position.

The catch member 164 is in the form of a plate that is positioned on or near bottom of the cup-like portion 184 of the housing 160. The catch member 164 is guided in its linear movement between the engaged and disengaged positions by guide brackets 220 and guide opening 222. The guide brackets 220 are supported by the bottom of the cup-like portion 184 of the housing 160. The guide opening 222 is provided in the guide plate 224 that is also supported by the bottom of the cup-like portion 184 of the housing 160. A torsion spring 226 is provided for biasing the catch member 164 toward the engaged position. The torsion spring 226 is maintained in a fixed location by a post 228 that projects from the bottom of the cup-like portion 184 and passes through the coiled portion of the torsion spring 226. One arm of the torsion spring 226 contacts the wall of the cup-like portion 184 and the other arm of the torsion spring 226 engages a groove 230 in the catch member 164 to thereby bias the catch member 164 toward the engaged position. When the catch member 164 is in the engaged position and the pawl 162 is in the latched position, the catch member 164 is positioned behind the lug 192, in engagement with the catch surface 168, and prevents the pawl 162 from rotating to the unlatched position.

The latch 100 is actuated by moving the handle 114 to the raised position. The handle 114 is designed such that a user can move the handle 114 to the raised position by hand. When the handle 114 is moved to the raised position, the catch member 164 is moved to the disengaged position such that the catch member 164 is moved out of engagement with the projection or lug 192 thereby freeing up the pawl 162 for pivoting. The catch member 164 is moved to the disengaged position as a result of the interaction of the actuating member 112 and the inclined surface 166, as has already been described, as the actuating member 112 is moved to the extended position responsive to the movement of the handle 114 to the raised position. The bias provided by the pawl torsion spring 198 rotates the pawl 162 from its latched position illustrated in FIG. 84, where the keeper rod 178 is cooperatively captured by the pawl slot 172 and the U-shaped indentation 182, toward its unlatched position illustrated in FIG. 91. The rotation of the pawl 162 brings the opening of the pawl slot 172 out from the portion of the slot 186 formed in the side of the U-shaped indentation 182 distal from the cup-like portion 184, such that the opening of the pawl slot 172 faces roughly toward the base 194 of the keeper rod 178, thus allowing the keeper 178 to be disengaged from the pawl 162. The door 102 can then be opened by moving it to the open position.

The cup-like portion 184 has an open top that is surrounded by a second flange 232. Distributed along the wall of the cup-like portion 184 are a plurality of pockets 234 designed to register with and optionally receive a portion of the sleeves 156. A hole 236 is provided at the bottom of each pocket 234 that registers with a respective one of the holes 158. A hole 238 is provided in the bottom of the cup-like portion 184 that registers with the post member 122 when the modules 106 and 108 are assembled together. The opening 238 is sized to provide clearance for the post member 122 of the actuating member 112. Another opening 240 is provided in the catch member 164 adjacent the inclined surface 166 that registers with the opening 238 and the post member 122 when the catch member 164 is in the disengaged position. The opening 240 is located such that is at the bottom of the inclined surface 166 as viewed from the position of the post member 122. This arrangement allows the post member 122 to be made arbitrarily long such that a range of thicknesses for the door 102 can be accommodated between the flanges 130 and 232 while the actuator module 108 remains capable of actuating the latch module 106. The inclined surface 166 at least partially covers the opening 238 such that at least a portion of the inclined surface 166 is in registry with the post member 122 when the catch member 164 is in the engaged position.

The plurality of holes 236 are distributed evenly around the hole 238 with each hole 236 being equidistant from the hole 238 and thus the longitudinal axis of the post member 122 when the modules 106 and 108 are assembled together. Thus, the holes 236 are distributed evenly along a circular arc having a center through which the longitudinal axis of the post member 122 passes. In the illustrated embodiment there are four holes 236 at 90° intervals.

The latch 100 is adapted for attachment to a first member, such as door 102, and the keeper rod 178 is attachable to a second member, such as door frame 104, as illustrated in FIGS. 84-86 and 91. The latch 100 secures the first member in a closed position relative to the second member when the latch 100 is attached to the first member, the keeper rod 178 is attached to the second member, and the keeper rod 178 passes through the pawl slot 172 with the pawl in the latched position. As mentioned previously, the door 102 has an opening 132 adapted for mounting of the latch 100 to the door 102. The first housing 110 is adapted to be mounted in the opening 132 in the door 102 such that the cup-like portion 128 passes into the opening 132 and the flange 130 abuts the exterior surface of the door adjacent the opening 132. Once the actuator module 108 is positioned in the opening 132 with the flange 130 abutting the exterior surface of the door 102, the latch module 106 can be secured to the actuator module 108 to thereby secure the latch 100 to the door 102. The latch module 106 can be secured to the actuator module 108 by placing the plurality of holes 236 in registry with the plurality of holes 156. Appropriate fasteners such as, for example, one or more self-tapping screws 242 can then be passed through the holes 236 and engaged to the holes 156 to secure the latch module 106 to the actuator module 108. Once the latch 100 is mounted to the door 102 the second flange 232 abuts the interior surface of the door 102 adjacent the opening 132.

The first flange 130 is too large to pass through the opening 132, and the second flange 232 is too large to pass through the opening 132. Accordingly, a portion of the first member, in this example the door 102, adjacent the opening 132 is captured between the first flange 130 and the second flange 232 when the latch 100 is attached to the first member with the second housing 160 secured to the first housing 110.

It should be apparent that because the holes 156 and 236 are evenly distributed about the longitudinal axis of the post member 122 and are equidistant from the longitudinal axis of the post member 122, the holes 156 and 236 can be brought into registry with one another with the latch module 106 in any one of a plurality angular orientations relative to the actuator module 108, wherein the angular orientations are determined as a relative rotation about an imaginary axis coincident with the longitudinal axis of the post member 122. In addition, the post member 122 will be in the same position relative to the latch module 106 with the latch module 106 secured to the actuator module 108 in every one of the plurality of angular orientations. Moreover, the latch 100 will remain fully operational with the latch module 106 secured to the actuator module 108 in every one of the plurality of angular orientations. Thus, the latch 100 has multi-directional capability. Furthermore, this multi-directional capability is obtained without the user having to modify either the latch module 106 or the actuator module 108 and without the user having to specially position any part of either module relative to the parts respective module prior to assembly of the latch 100. A further feature of the latch 100 is that during operation of the latch 100 between the latched configuration and the unlatched configuration the latch module 106 remains in the user selected one of the plurality of angular orientations relative to the actuator module 108.

In the illustrated embodiment, because there are four holes 156 and four holes 236 at 90° intervals, the latch module 106 can be secured to the actuator module 108 in any one of four separate angular orientations as illustrated in FIGS. 1-30. The number of angular orientations can vary from two to a very large whole number limited by the number of holes that can fit along the same circular arc. For most practical application, however, four angular orientations is believed to be sufficient. Furthermore, if a plurality of holes are provided in one module that are equidistant from the longitudinal axis of the post member 122, then it would be sufficient to have at least one hole in the other module at the same distance from the longitudinal axis of the post member 122 to obtain multi-directional capability in the latch. However, for strength and security it is preferred to have the same number of holes in both modules.

When the door 102 is being closed, the opening of the pawl slot 172 faces toward the keeper rod 178 and is unobstructed by the lateral sides of the U-shaped indentation 182. As the door 102 is slammed shut, the keeper rod 178 impacts the pawl 162 causing the rotation of the pawl 162 toward the latched position shown in FIG. 84. As the pawl 162 rotates toward the latched position the keeper rod 178 is received in the pawl slot 172. At this time the catch member 164 is partially retracted because the lug 192 pushes the catch member 164 out of the way as the pawl 162 rotates toward the latched position. As the pawl 162 rotates to the latched position, the lug 192 clears the catch member 164 allowing the catch member 164 to extend to the engaged position under the bias of spring 226 and move behind the lug 192. Once the catch member 164 is in the engaged position it catches the catch surface 168 of the projection 192 to keep the pawl 162 in the latched position illustrated in FIG. 91, thus securing the door 102 in the closed position.

It should be noted that the term user as used in the claims refers not just to an end user of the latch but also to an original equipment manufacturer that installs the latch in his or her product. Also, the term housing is broadly used in the claims with respect to a given module to denote any structure that maintains the parts of that module in operational relationship, except where the claim recites specific structural features of the module housing. Furthermore, the holes in at least one module may be replaced by elongated slots that extend along the same circular arc defined by the holes of the other module. Alternatively, the modules may be clamped together eliminating the need for holes or slots in one or both modules.

The handle 114 can be locked in the folded-down position by using a key to turn the lock plug 116 to the locked position. In the locked position the longitudinal axis of the channel 150 is parallel to the axis of rotation of the handle 114. In this position, the sides of the channel 150 interfere with a projection 244 projecting upward into the channel 150 from the bottom of the base 120 of the actuating member 112. When the lock plug is turned to the unlocked position by an appropriate key, then the longitudinal axis of the channel 150 is perpendicular to the axis of rotation of the handle 114. In the unlocked position, the open ends of the channel 150 allow the projection 244 to clear the channel 150 as the handle 114 is moved to the raised position, thus unlocking the handle 114.

Another feature of the latch 100 is that if the lock plug 116 is turned to the locked position with the handle 114 in the raised position then the projection 244 interferes with the land 246 on one side of the channel 150 to maintain the handle 114 in an intermediate position between the raised position and the folded-down position when the handle is released by a user from the raised position with the lock plug in the locked position. While the handle 114 is in the intermediate position, the user can freely unlatch the door for frequent access with the handle 114 affording a convenient grip in the intermediate position. When the user wishes to finally lock down the handle, the user has to push down the handle toward the folded-down position with sufficient force to overcome the biasing force of the spring 126 to push the handle to the folded-down position and in the locked condition without having to use a key. Thus, the projection 244 also provides a detent for maintaining the handle 114 in an intermediate position temporarily.

Referring to FIGS. 92-111 a second embodiment of an actuator module 108*a* for use with the second embodiment 100*a* of a latch according to the present invention can be seen. The latch 100*a* includes a latch module 106 that has already been described in reference to the latch 100. The actuator module 108*a* is generally similar to the actuator module 108 except for the few differences that are noted below. The first difference is that the bottom of the cup-like portion 128*a* of the housing 110*a* in the region below the finger access opening 138 of the handle 114 has been deepened. In the housing 110*a* the deepening of the cup-like portion of the housing 110*a* below the finger access opening of the handle 114 is achieved by providing for the bottom of the cup-like portion 128*a* to extend along a sweeping arc from the front wall 300 of the cup-like portion 128*a* to the bottom of the receptacle 152 to form the sweeping face 302. This will give the user increased finger clearance. A cylindrical well 304 is provided around the round opening 154 on the interior of the receptacle 152. The well 304 is provided on center with the opening 154. The well 304 receives at least a portion of the spring 126 with at least some of the coils of the spring 126 being positioned around the post member 122. Thus the well 304 keeps the compression spring 126 centered around the post member 122. In addition, the well 304 inhibits water flow, for example from rain or puddles or from a hose during washing, through the opening 154 and into the compartment secured by the latch 100*a*. Furthermore, the well 304 houses the sealing washer 306.

The sealing washer 306 includes a metal ring 308 with an over-molded rubber-like portion 310 that will act like a "wiper" on the post member 122. This "wiper" effect is for the purpose of preventing water from entering the compartment secured by the latch 100*a*. The sealing washer is installed in the bottom of the well 304. Then the compression spring 126 is placed between the sealing washer 306 and the base 120 of the actuating member 112. The force exerted by the spring 126 will keep the sealing washer 306 against the bottom of the well 304 and press the rubber-like portion 310 into position over the gap between post member 122 and the opening 154 to effect a good seal not just around the post member 122 but also between the sealing washer 306 and the bottom of the well 304.

In addition, a rib 312 is provided between the receptacle 152 and the region of the bottom of the cup-like portion 128*a* of the housing 110*a* below the finger access opening 138 of the handle 114. The profile of the rib 312 follows the profile of the bottom skirt 314 of the handle 114. The purpose for this rib is to protect the components under the handle from tampering, finger access, and/or a direct water jet (such as that caused by a hose when washing the exterior of the compartment secured by the latch 100*a*).

Otherwise the actuator modules 108 and 108*a*, and consequently the latches 100 and 100*a*, are identical.

Figure 112:
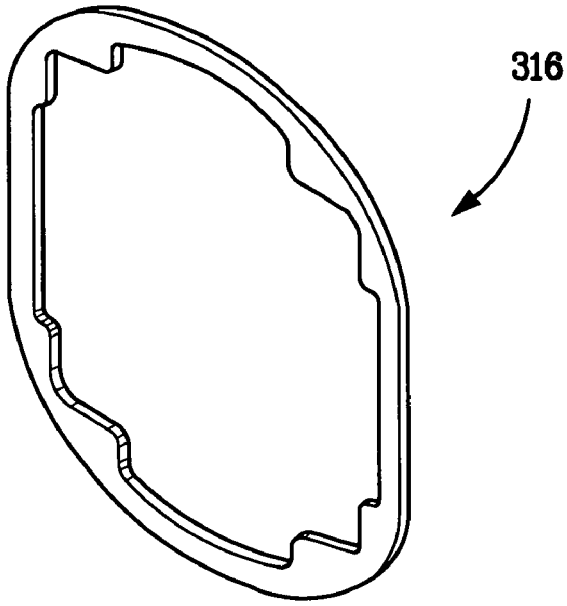
FIGS. 112-113 are views of a sealing gasket for use with the latch according to the present invention.
Figure 113:
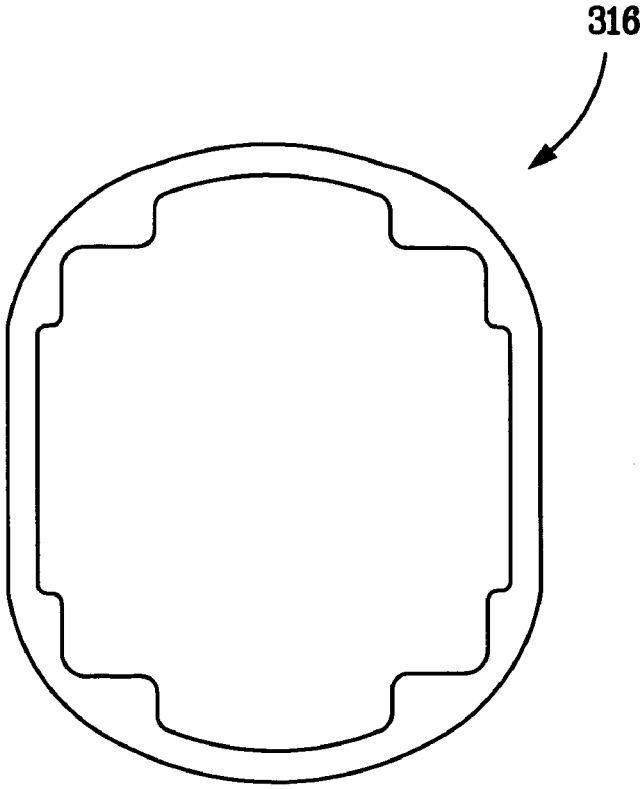

Referring to FIGS. 112-113 a sealing gasket 316 for use with the latches 100 and 100*a* can be seen. The gasket 316 fits under the bezel 130 and seals any gaps between the housing 110 or 110*a* and the opening 132 in the door 102.

It is to be understood that the present invention is not limited to the embodiments disclosed above, but includes any and all embodiments within the scope of the appended claims.

The invention claimed is:

1. A latch comprising:

a latch module including at least a portion of a latching mechanism; and an actuator module, wherein said latch module can be secured to said actuator module in any one of a plurality of angular orientations relative to said actuator module, such that a user can secure said latch module to said actuator module with said latch module being in a user selected one of said plurality of angular orientations relative to said actuator module, wherein the latch can be operated to assume a latched configuration and an unlatched configuration, wherein during operation of the latch between said latched configuration and said unlatched configuration said latch module at least in part remains in said user selected one of said plurality of angular orientations relative to said actuator module, wherein said actuator module comprises an actuating member having a longitudinal axis and said actuating member remains in a position to engage said latch module such that the latch remains operable with said latch module secured to said actuator module in any one of said plurality of angular orientations, said plurality of angular orientations being determined by reference to rotation about an imaginary axis passing through said actuator module, wherein said actuator module further comprises a first housing supporting said actuating member, wherein said latch module comprises a second housing supporting a pawl, wherein the latch remains operable with said second housing secured to said first housing in any one of a plurality of angular orientations relative to said first housing about said imaginary axis, wherein said imaginary axis is coincident with said longitudinal axis of said actuating member, and wherein said plurality of angular orientations of said second housing relative to said first housing define said plurality of angular orientations of said latch module relative to said actuator module, wherein said actuating member is supported by said first housing for linear movement directed along said imaginary axis, and wherein said actuator module further comprises a handle pivotally attached to said first housing, said handle moving pivotally between a raised position and a folded-down position, said actuating member moving linearly along said imaginary axis in response to said handle moving between said raised position and said folded-down position.

2. The latch according to claim 1, wherein said plurality of angular orientations include at least three angular orientations.

3. The latch according to claim 1, wherein said actuator module has a first plurality of holes and said latch module has a second plurality of holes, said second plurality of holes registering with said first plurality of holes with said latch module being in any one of said plurality of angular orientations relative to said actuator module, said plurality of angular orientations being determined by reference to rotation about an imaginary axis passing through said actuator module, whereby said latch module can be secured to said actuator module in any one of said plurality of angular orientations by using appropriate fasteners cooperating with said first plurality of holes and said second plurality of holes.

4. The latch according to claim 1, wherein said latch module has at least one hole and said actuator module has a plurality of holes, said at least one hole of said latch module being capable of registering with any one of said plurality of holes of said actuator module to thereby allow a user to secure said latch module to said actuator module in said user selected one of said plurality of angular orientations by the user placing said at least one hole of said latch module in registry with a user selected one of said plurality of holes of said actuator module and then using at least one appropriate fastener cooperating with said at least one hole of said latch module and said user selected one of said plurality of holes of said actuator module to secure said latch module to said actuator module, said plurality of angular orientations being determined by reference to rotation about an imaginary axis passing through said actuator module.

5. The latch according to claim 1, wherein said latch module has a plurality of holes and said actuator module has at least one hole, said at least one hole of said actuator module being capable of registering with any one of said plurality of holes of said latch module to thereby allow a user to secure said latch module to said actuator module in said user selected one of said plurality of angular orientations by the user placing said at least one hole of said actuator module in registry with a user selected one of said plurality of holes of said latch module and then using at least one appropriate fastener cooperating with said at least one hole of said actuator module and said user selected one of said plurality of holes of said latch module to secure said latch module to said actuator module, said plurality of angular orientations being determined by reference to rotation about an imaginary axis passing through said actuator module.

6. The latch according to claim 1, wherein said pawl is supported by said second housing for rotary movement between latched and unlatched positions relative to said second housing.

7. The latch according to claim 6, wherein said pawl is spring biased toward said unlatched position, wherein said latch module further comprises a catch member movable between engaged and disengaged positions and biased toward said engaged position, wherein said catch member maintains said pawl in said latched position when said pawl is in said latched position and said catch member is in said engaged position, and wherein said pawl is released for movement to said unlatched position under spring bias when said catch member is moved to said disengaged position.

8. The latch according to claim 7, wherein said actuating member is adapted to selectively engage said catch member to thereby move said catch member to said disengaged position.

9. The latch according to claim 8, wherein said actuating member includes a base and a post member that projects from said base, said post member having a longitudinal axis that defines said longitudinal axis of said actuating member, said base having a cam surface, said handle having a cam surface that engages said cam surface of said base to move said actuating member linearly along said imaginary axis from a retracted position to an extended position as said handle is pivotally moved from said folded-down position to said raised position.

10. The latch according to claim 9, wherein said catch member has an inclined surface and said post member of said actuating member engages said inclined surface to move said catch member from said engaged position to said disengaged position as said actuating member is moved linearly from said retracted position to said extended position when said latch module is secured to said actuating module in said user selected one of said plurality of angular orientations of said latch module relative to said actuator module.

11. The latch according to claim 10, wherein said pawl has a catch surface that is engaged by said catch member to retain said pawl in said latched position when said pawl is in said latched position and said catch member is in said engaged position.

12. The latch according to claim 11, wherein said pawl moves rotationally between said latched position and said unlatched position about an axis of rotation, wherein said pawl has a pawl slot having an open end, wherein said second housing has a crook portion that overhangs said axis of rotation such that said crook portion obstructs said open end of said pawl slot when said pawl is in said latched position, and wherein said open end of said pawl slot is positioned for unobstructed access from at least one direction by a keeper rod when said pawl is in said unlatched position.

13. The latch according to claim 12, wherein the latch is adapted for attachment to a first member and the keeper rod is attached to a second member and the latch secures the first member in a closed position relative to the second member when the latch is attached to the first member and the keeper rod passes through said pawl slot with said pawl in a latched position, wherein the first member has an opening adapted for mounting of the latch to the first member, wherein said first housing has a first flange that is too large to pass through said opening, wherein said second housing has a second flange that is too large to pass through said opening, and wherein a portion of the first member adjacent the opening is captured between said first flange and said second flange when the latch is attached to the first member with said second housing secured to said first housing.

14. The latch according to claim 13, wherein said pawl has a cam surface defining one side of said open end of said pawl slot, and wherein said cam surface at said open end of said pawl slot is impacted by the keeper rod to thereby initiate rotation of said pawl from said unlatched position toward said latched position and further engagement of the keeper rod with said pawl slot causes further rotation of said pawl toward said latched position as the first member is moved to the closed position relative to the second member, such that movement of said pawl to said latched position is accomplished by moving the first member to the closed position relative to the second member.

15. The latch according to claim 1, wherein said actuating member includes a base and a post member that projects from said base, said post member having a longitudinal axis that defines said longitudinal axis of said actuating member, said base having a cam surface, said handle having a cam surface that engages said cam surface of said base to move said actuating member linearly along said imaginary axis from a retracted position to an extended position as said handle is pivotally moved from said folded-down position to said raised position.

16. The latch according to claim 1, wherein said second housing has at least one hole and said first housing has a plurality of holes, said at least one hole of said second housing registering with a user selected one of said plurality of holes of said first housing to thereby allow said second housing to be secured to said first housing in said user selected one of said plurality of angular orientations by using at least one appropriate fastener cooperating with said at least one hole of said second housing and said user selected one of said plurality of holes of said first housing.

17. The latch according to claim 16, wherein the at least one appropriate fastener is threaded, and the at least one appropriate fastener can pass through said at least one hole of said second housing and engage said user selected one of said plurality of holes of said first housing to thereby secure said second housing to said first housing in said user selected one of said plurality of angular orientations.

18. The latch according to claim 16, wherein said pawl is supported by said second housing for rotary movement between latched and unlatched positions relative to said second housing.

19. The latch according to claim 18, wherein said pawl is spring biased toward said unlatched position, wherein said latch module further comprises a catch member movable between engaged and disengaged positions and biased toward said engaged position, wherein said catch member maintains said pawl in said latched position when said pawl is in said latched position and said catch member is in said engaged position, and wherein said pawl is released for movement to said unlatched position under spring bias when said catch member is moved to said disengaged position.

20. The latch according to claim 19, wherein said actuating member is adapted to selectively engage said catch member to thereby move said catch member to said disengaged position.

21. The latch according to claim 20, wherein said actuating member includes a base and a post member that projects from said base, said post member having a longitudinal axis that defines said longitudinal axis of said actuating member, said base having a cam surface, said handle having a cam surface that engages said cam surface of said base to move said actuating member linearly along said imaginary axis from a retracted position to an extended position as said handle is pivotally moved from said folded-down position to said raised position.

22. The latch according to claim 21, wherein said catch member has an inclined surface and said post member of said actuating member engages said inclined surface to move said catch member from said engaged position to said disengaged position as said actuating member is moved linearly from said retracted position to said extended position when said latch module is secured to said actuating module in said user selected one of said plurality of angular orientations of said latch module relative to said actuator module.

23. The latch according to claim 22, wherein said pawl has a catch surface that is engaged by said catch member to retain said pawl in said latched position when said pawl is in said latched position and said catch member is in said engaged position.

24. The latch according to claim 23, wherein said pawl moves rotationally between said latched position and said unlatched position about an axis of rotation, wherein said pawl has a pawl slot having an open end, wherein said second housing has a crook portion that overhangs said axis of rotation such that said crook portion obstructs said open end of said pawl slot when said pawl is in said latched position, and wherein said open end of said pawl slot is positioned for unobstructed access from at least one direction by a keeper rod when said pawl is in said unlatched position.

25. The latch according to claim 24, wherein the latch is adapted for attachment to a first member and the keeper rod is attached to a second member and the latch secures the first member in a closed position relative to the second member when the latch is attached to the first member and the keeper rod passes through said pawl slot with said pawl in a latched position, wherein the first member has an opening adapted for mounting of the latch to the first member, wherein said first housing has a first flange that is too large to pass through said opening, wherein said second housing has a second flange that is too large to pass through said opening, and wherein a portion of the first member adjacent the opening is captured between said first flange and said second flange when the latch is attached to the first member with said second housing secured to said first housing.

26. The latch according to claim 25, wherein said pawl has a cam surface defining one side of said open end of said pawl slot, and wherein said cam surface at said open end of said pawl slot is impacted by the keeper rod to thereby initiate rotation of said pawl from said unlatched position toward said latched position and further engagement of the keeper rod with said pawl slot causes further rotation of said pawl toward said latched position as the first member is moved to the closed position relative to the second member, such that movement of said pawl to said latched position is accomplished by moving the first member to the closed position relative to the second member.

27. The latch according to claim 16, wherein said actuating member includes a base and a post member that projects from said base, said post member having a longitudinal axis that defines said longitudinal axis of said actuating member, said base having a cam surface, said handle having a cam surface that engages said cam surface of said base to move said actuating member linearly along said imaginary axis from a retracted position to an extended position as said handle is pivotally moved from said folded-down position to said raised position.

28. The latch according to claim 1, wherein said first housing has at least one hole and said second housing has a plurality of holes, said at least one hole of said first housing registering with a user selected one of said plurality of holes of said second housing to thereby allow said second housing to be secured to said first housing in said user selected one of said plurality of angular orientations by using at least one appropriate fastener cooperating with said at least one hole of said first housing and said user selected one of said plurality of holes of said second housing.

29. The latch according to claim 28, wherein the at least one appropriate fastener is threaded, and the at least one appropriate fastener can pass through said user selected one of said plurality of holes of said second housing and engage said at least one hole of said first housing to thereby secure said second housing to said first housing in said user selected one of said plurality of angular orientations.

30. The latch according to claim 28, wherein said pawl is supported by said second housing for rotary movement between latched and unlatched positions relative to said second housing.

31. The latch according to claim 30, wherein said pawl is spring biased toward said unlatched position, wherein said latch module further comprises a catch member movable between engaged and disengaged positions and biased toward said engaged position, wherein said catch member maintains said pawl in said latched position when said pawl is in said latched position and said catch member is in said engaged position, and wherein said pawl is released for movement to said unlatched position under spring bias when said catch member is moved to said disengaged position.

32. The latch according to claim 31, wherein said actuating member is adapted to selectively engage said catch member to thereby move said catch member to said disengaged position.

33. The latch according to claim 32, wherein said actuating member includes a base and a post member that projects from said base, said post member having a longitudinal axis that defines said longitudinal axis of said actuating member, said base having a cam surface, said handle having a cam surface that engages said cam surface of said base to move said actuating member linearly along said imaginary axis from a retracted position to an extended position as said handle is pivotally moved from said folded-down position to said raised position.

34. The latch according to claim 33, wherein said catch member has an inclined surface and said post member of said actuating member engages said inclined surface to move said catch member from said engaged position to said disengaged position as said actuating member is moved linearly from said retracted position to said extended position when said latch module is secured to said actuating module in said user selected one of said plurality of angular orientations of said latch module relative to said actuator module.

35. The latch according to claim 34, wherein said pawl has a catch surface that is engaged by said catch member to retain said pawl in said latched position when said pawl is in said latched position and said catch member is in said engaged position.

36. The latch according to claim 35, wherein said pawl moves rotationally between said latched position and said unlatched position about an axis of rotation, wherein said pawl has a pawl slot having an open end, wherein said second housing has a crook portion that overhangs said axis of rotation such that said crook portion obstructs said open end of said pawl slot when said pawl is in said latched position, and wherein said open end of said pawl slot is positioned for unobstructed access from at least one direction by a keeper rod when said pawl is in said unlatched position.

37. The latch according to claim 36, wherein the latch is adapted for attachment to a first member and the keeper rod is attached to a second member and the latch secures the first member in a closed position relative to the second member when the latch is attached to the first member and the keeper rod passes through said pawl slot with said pawl in a latched position, wherein the first member has an opening adapted for mounting of the latch to the first member, wherein said first housing has a first flange that is too large to pass through said opening, wherein said second housing has a second flange that is too large to pass through said opening, and wherein a portion of the first member adjacent the opening is captured between said first flange and said second flange when the latch is attached to the first member with said second housing secured to said first housing.

38. The latch according to claim 37, wherein said pawl has a cam surface defining one side of said open end of said pawl slot, and wherein said cam surface at said open end of said pawl slot is impacted by the keeper rod to thereby initiate rotation of said pawl from said unlatched position toward said latched position and further engagement of the keeper rod with said pawl slot causes further rotation of said pawl toward said latched position as the first member is moved to the closed position relative to the second member, such that movement of said pawl to said latched position is accomplished by moving the first member to the closed position relative to the second member.

39. The latch according to claim 28, wherein said actuating member includes a base and a post member that projects from said base, said post member having a longitudinal axis that defines said longitudinal axis of said actuating member, said base having a cam surface, said handle having a cam surface that engages said cam surface of said base to move said actuating member linearly along said imaginary axis from a retracted position to an extended position as said handle is pivotally moved from said folded-down position to said raised position.

40. The latch according to claim 1, wherein said first housing has a first plurality of holes and said second housing has a second plurality of holes, said second plurality of holes registering with said first plurality of holes with said second housing being in any one of said plurality of angular orientations to thereby allow said second housing to be secured to said first housing in said user selected one of said plurality of angular orientations by using a plurality of appropriate fasteners in cooperation with said first plurality of holes and said second plurality of holes.

41. The latch according to claim 40, wherein the plurality of appropriate fasteners are threaded, and each of the plurality of appropriate fasteners can pass through a respective one of said second plurality of holes engage a respective one of said first plurality of holes to thereby secure said second housing to said first housing in said user selected one of said plurality of angular orientations.

42. The latch according to claim 40, wherein said pawl is supported by said second housing for rotary movement between latched and unlatched positions relative to said second housing.

43. The latch according to claim 42, wherein said pawl is spring biased toward said unlatched position, wherein said latch module further comprises a catch member movable between engaged and disengaged positions and biased toward said engaged position, wherein said catch member maintains said pawl in said latched position when said pawl is in said latched position and said catch member is in said engaged position, and wherein said pawl is released for movement to said unlatched position under spring bias when said catch member is moved to said disengaged position.

44. The latch according to claim 43, wherein said actuating member is adapted to selectively engage said catch member to thereby move said catch member to said disengaged position.

45. The latch according to claim 44, wherein said actuating member includes a base and a post member that projects from said base, said post member having a longitudinal axis that defines said longitudinal axis of said actuating member, said base having a cam surface, said handle having a cam surface that engages said cam surface of said base to move said actuating member linearly along said imaginary axis from a retracted position to an extended position as said handle is pivotally moved from said folded-down position to said raised position.

46. The latch according to claim 45, wherein said catch member has an inclined surface and said post member of said actuating member engages said inclined surface to move said catch member from said engaged position to said disengaged position as said actuating member is moved linearly from said retracted position to said extended position when said latch module is secured to said actuating module in said user selected one of said plurality of angular orientations of said latch module relative to said actuator module.

47. The latch according to claim 46, wherein said pawl has a catch surface that is engaged by said catch member to retain said pawl in said latched position when said pawl is in said latched position and said catch member is in said engaged position.

48. The latch according to claim 47, wherein said pawl moves rotationally between said latched position and said unlatched position about an axis of rotation, wherein said pawl has a pawl slot having an open end, wherein said second housing has a crook portion that overhangs said axis of rotation such that said crook portion obstructs said open end of said pawl slot when said pawl is in said latched position, and wherein said open end of said pawl slot is positioned for unobstructed access from at least one direction by a keeper rod when said pawl is in said unlatched position.

49. The latch according to claim 48, wherein the latch is adapted for attachment to a first member and the keeper rod is attached to a second member and the latch secures the first member in a closed position relative to the second member when the latch is attached to the first member and the keeper rod passes through said pawl slot with said pawl in a latched position, wherein the first member has an opening adapted for mounting of the latch to the first member, wherein said first housing has a first flange that is too large to pass through said opening, wherein said second housing has a second flange that is too large to pass through said opening, and wherein a portion of the first member adjacent the opening is captured between said first flange and said second flange when the latch is attached to the first member with said second housing secured to said first housing.

50. The latch according to claim 49, wherein said pawl has a cam surface defining one side of said open end of said pawl slot, and wherein said cam surface at said open end of said pawl slot is impacted by the keeper rod to thereby initiate rotation of said pawl from said unlatched position toward said latched position and further engagement of the keeper rod with said pawl slot causes further rotation of said pawl toward said latched position as the first member is moved to the closed position relative to the second member, such that movement of said pawl to said latched position is accomplished by moving the first member to the closed position relative to the second member.

51. The latch according to claim 40, wherein said actuating member includes a base and a post member that projects from said base, said post member having a longitudinal axis that defines said longitudinal axis of said actuating member, said base having a cam surface, said handle having a cam surface that engages said cam surface of said base to move said actuating member linearly along said imaginary axis from a retracted position to an extended position as said handle is pivotally moved from said folded-down position to said raised position.

52. The latch according to claim 1, wherein the latch can be used for releasably securing a first member in a closed position relative to a second member, wherein said actuator module further comprises:

a handle pivotally supported by said first housing, said handle being movable between a folded-down position and a raised position, said actuating member being movable and being biased toward a first position by a biasing force; and a lock plug carried by said handle, said lock plug being rotationally movable between a locked position and an unlocked position, at least a portion of said actuating member interfering with at least a portion of said lock plug to prevent movement of said handle to said raised position when said handle is in said folded-down position, said lock plug is in said locked position and said actuating member is in said first position, said handle being movable by a user to said raised position from said folded-down position when said lock plug is in said unlocked position, at least a portion of said actuating member interfering with at least a portion of said lock plug to maintain said handle in an intermediate position between said raised position and said folded-down position when said handle is released by a user from said raised position with said lock plug in said locked position, wherein said handle can be moved from said intermediate position to said folded-down position to thereby lock said handle in said folded-down position when said handle in said intermediate position is pushed by a user toward said folded-down position with sufficient force to overcome said biasing force.

53. The latch according to claim 52, wherein said actuating member is movable responsive to movement of said handle over at least a portion of a range of motion of said handle, said range of motion of said handle being limited by said folded-down position and said raised position, wherein said latch module is engageable by said actuating member, said latch module is operable between a latched configuration and an unlatched configuration, said latch module is capable of operation between said latched configuration and said unlatched configuration with said handle in said intermediate position and with said lock plug in said locked position, and pushing said handle from said intermediate position to said folded-down position with the first member in the closed position relative to the second member, and with said lock plug in said locked position, locks the first member in the closed position relative to the second member.

54. A latch comprising:

an actuator module having a first plurality of holes, said actuator module comprising an actuating member having a longitudinal axis, said first plurality of holes being distributed about said actuating member with said longitudinal axis said actuating member being centrally located with respect to said first plurality of holes, said actuating member being supported for linear movement directed along said longitudinal axis thereof, and said actuator module further comprising a handle pivotally supported for moving pivotally between a raised position and a folded-down position, said actuating member moving linearly along said longitudinal axis thereof in response to said handle moving between said raised position and said folded-down position; and a latch module including at least a portion of a latching mechanism, said latch module having a second plurality of holes adapted to register with said first plurality of holes with said latch module in any one of a plurality of angular orientations relative to said actuator module, wherein a position of said actuating member relative to said latch module remains essentially unchanged regardless of which one of said plurality of angular orientations is selected when securing said latch module to said actuator module.

55. A latch for releasably securing a first member in a closed position relative to a second member, the first member having an opening adapted for mounting of the latch to the first member, the latch comprising:

an actuator module comprising a first housing, said first housing having a first flange; and a latch module including at least a portion of a latching mechanism, said latch module comprising a second housing, said second housing having a second flange, wherein said first flange and said second flange are adapted to allow a portion of the first member adjacent the opening to be captured between said first flange and said second flange when the latch is attached to the first member with said second housing secured to said first housing and when the opening in the first member is sized such that both said first flange and said second flange are too large to pass through the opening, wherein said actuator module further comprises an actuating member supported by said first housing, wherein said actuating member has a longitudinal axis, wherein said latch module further comprises a pawl supported by said second housing, wherein the latch remains operable with said second housing secured to said first housing in a user selected one of a plurality of angular orientations relative to said first housing about an imaginary axis coincident with said longitudinal axis of said actuating member, wherein said actuating member is supported by said first housing for linear movement directed along said imaginary axis, and wherein said actuator module further comprises a handle pivotally attached to said first housing, said handle moving pivotally between a raised position and a folded-down position, said actuating member moving linearly along said imaginary axis in response to said handle moving between said raised position and said folded-down position.

* * * * *